US009976239B2

(12) United States Patent
Suzuki et al.

(10) Patent No.: US 9,976,239 B2
(45) Date of Patent: May 22, 2018

(54) EMBROIDERY SEWING MACHINE

(71) Applicant: JANOME SEWING MACHINE CO., LTD., Hachioji-shi, Tokyo (JP)

(72) Inventors: Ryosuke Suzuki, Hachioji (JP); Takeshi Kongo, Hachioji (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 170 days.

(21) Appl. No.: 15/181,815

(22) Filed: Jun. 14, 2016

(65) Prior Publication Data

US 2017/0175314 A1 Jun. 22, 2017

(30) Foreign Application Priority Data

Dec. 18, 2015 (JP) ..... 2015-247183

(51) Int. Cl.
*D05B 19/00* (2006.01)
*D05C 9/04* (2006.01)
*D05B 19/10* (2006.01)

(52) U.S. Cl.
CPC ..... *D05B 19/105* (2013.01); *D05B 19/10* (2013.01); *D05C 9/04* (2013.01)

(58) Field of Classification Search
CPC ..... D05B 19/105; D05B 19/00–19/16; D05B 21/00; D05B 39/00; D05C 9/04; D05C 9/06; D05C 9/10; D05C 3/02
See application file for complete search history.

(56) References Cited

U.S. PATENT DOCUMENTS

| | | | | |
|---|---|---|---|---|
| 5,867,391 | A * | 2/1999 | Muto | D05B 19/08 112/103 |
| 7,085,617 | B2 * | 8/2006 | Kaiya | D05B 19/10 112/475.19 |
| 2008/0216725 | A1 * | 9/2008 | Tokura | D05B 19/08 112/470.04 |
| 2015/0144043 | A1 * | 5/2015 | Maki | D05B 19/02 112/102.5 |
| 2015/0225882 | A1 * | 8/2015 | Ihira | D05B 19/04 112/102.5 |

FOREIGN PATENT DOCUMENTS

| | | |
|---|---|---|
| JP | 1-223993 A | 9/1989 |
| JP | 8-57173 A | 3/1996 |

* cited by examiner

*Primary Examiner* — Ismael Izaguirre
(74) *Attorney, Agent, or Firm* — Westerman, Hattori, Daniels & Adrian, LLP

(57) ABSTRACT

An embroidery sewing machine includes a storage device storing coordinate data of an embroidery pattern; an X-Y moving mechanism that moves an embroidery frame in X- and Y-directions based on the coordinate data; a display device that displays the embroidery pattern; a transparent touchscreen; a touch point detector that detects a position of touch on the touchscreen; a coordinate data extracting unit that extracts coordinate data within a certain distance from the detected position of touch; a coordinate data selecting unit that selects a coordinate data candidate from the extracted coordinate data; a candidate list display unit that displays a list of a needle position candidate based on the selected coordinate data; and a coordinate data supplying unit that supplies, when any needle position is specified, the X-Y moving mechanism with coordinate data of the specified needle position and moves the embroidery frame to the needle position.

24 Claims, 20 Drawing Sheets

FIG. 1
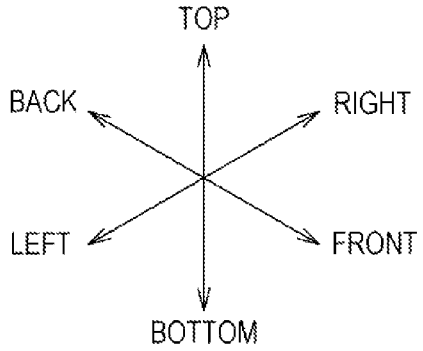
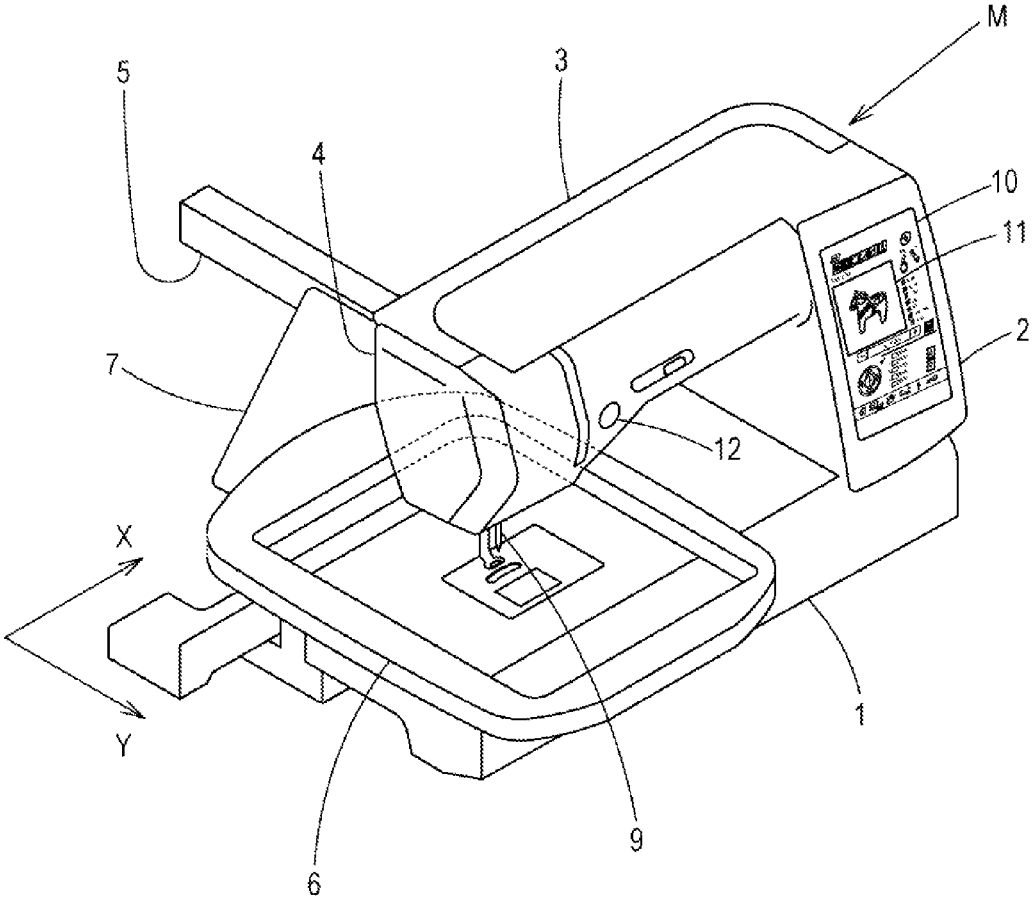

FIG. 18A

| COUNTER | STITCH ORDINAL NUMBER | LAYER | DISTANCE | VALID/INVALID |
|---|---|---|---|---|
| 1 | 1 | 1 | d | VALID |
| | : | : | : | : |
| 17 | 17(A) | 1 | $\sqrt{2}$ | VALID |
| 18 | 18(B) | 1 | 1 | VALID |
| 19 | 19(C) | 1 | 1 | VALID |
| | : | : | : | : |
| 202 | 202(D) | 1 | $\sqrt{2}$ | VALID |
| 203 | 203(E) | 1 | 1 | VALID |
| 204 | 204(F) | 1 | $\sqrt{2}$ | VALID |
| | : | : | : | : |
| 210 | 210(G) | 1 | $\sqrt{2}$ | VALID |
| 211 | 211(H) | 1 | 1 | VALID |
| | : | : | : | : |
| 240 | 240(I) | 2 | 0 | VALID |
| 241 | 241(J) | 2 | $\sqrt{2}$ | VALID |
| | : | : | : | : |

NUMBER OF STITCHES

FIG. 18B

| COUNTER | STITCH ORDINAL NUMBER | LAYER | DISTANCE | VALID/INVALID |
|---|---|---|---|---|
| 1 | 240(I) | 2 | 0 | VALID |
| 2 | 18(B) | 1 | 1 | VALID |
| 3 | 19(C) | 1 | 1 | VALID |
| 4 | 203(E) | 1 | 1 | VALID |
| 5 | 211(H) | 1 | 1 | VALID |
| 6 | 17(A) | 1 | $\sqrt{2}$ | VALID |
| 7 | 202(D) | 1 | $\sqrt{2}$ | VALID |
| 8 | 204(F) | 1 | $\sqrt{2}$ | VALID |
| 9 | 210(G) | 1 | $\sqrt{2}$ | VALID |
| 10 | 241(J) | 2 | $\sqrt{2}$ | VALID |
| 11 | : | : | : | INVALID |
| | : | : | : | : |

NUMBER OF STITCHES

FIG. 19A

| COUNTER | STITCH ORDINAL NUMBER | LAYER | DISTANCE | VALID/INVALID |
|---|---|---|---|---|
| 1 | 240 | 2 | 0 | VALID |
| 2 | 18 | 1 | 1 | VALID |
| 3 | 19 | 1 | 1 | VALID |
| 4 | 203 | 1 | 1 | VALID |
| 5 | 211 | 1 | 1 | VALID |
| 6 | 17 | 1 | $\sqrt{2}$ | VALID |
| 7 | 202 | 1 | $\sqrt{2}$ | VALID |
| 8 | 204 | 1 | $\sqrt{2}$ | VALID |
| 9 | 210 | 1 | $\sqrt{2}$ | VALID |
| 10 | 241 | 2 | $\sqrt{2}$ | INVALID |

COUNTER VALUE

TO-BE-COMPARED STITCHES

FIG. 19B

| COUNTER | STITCH ORDINAL NUMBER | LAYER | DISTANCE | VALID/INVALID |
|---|---|---|---|---|
| 1 | 240 | 2 | 0 | VALID |
| 2 | 18 | 1 | 1 | VALID |
| 3 | 19 | 1 | 1 | INVALID |
| 4 | 203 | 1 | 1 | VALID |
| 5 | 211 | 1 | 1 | VALID |
| 6 | 17 | 1 | $\sqrt{2}$ | INVALID |
| 7 | 202 | 1 | $\sqrt{2}$ | VALID |
| 8 | 204 | 1 | $\sqrt{2}$ | VALID |
| 9 | 210 | 1 | $\sqrt{2}$ | VALID |
| 10 | 241 | 2 | $\sqrt{2}$ | INVALID |

COUNTER VALUE

TO-BE-COMPARED STITCHES

FIG. 19C

| COUNTER | STITCH ORDINAL NUMBER | LAYER | DISTANCE | VALID/INVALID |
|---|---|---|---|---|
| 1 | 240(I) | 2 | 0 | VALID |
| 2 | 18(B) | 1 | 1 | VALID |
| 3 | 19(C) | 1 | 1 | INVALID |
| 4 | 203(E) | 1 | 1 | VALID |
| 5 | 211(H) | 1 | 1 | INVALID |
| 6 | 17(A) | 1 | $\sqrt{2}$ | INVALID |
| 7 | 202(D) | 1 | $\sqrt{2}$ | INVALID |
| 8 | 204(F) | 1 | $\sqrt{2}$ | INVALID |
| 9 | 210(G) | 1 | $\sqrt{2}$ | INVALID |
| 10 | 241(J) | 2 | $\sqrt{2}$ | INVALID |

COUNTER VALUE

TO-BE-COMPARED STITCHES

EMBROIDERY SEWING MACHINE

BACKGROUND OF THE INVENTION

1. Field of the Invention

The present invention relates to an embroidery sewing machine that stitches an embroidery pattern by attaching an object subjected to embroidery, such as fabric, to an embroidery frame and moving the embroidery frame in X- and Y-directions with respect to a needle that reciprocates vertically at a fixed position. More particularly, the present invention relates to an embroidery sewing machine capable of specifying an embroidery stitching resume position by directly touching a desired point on an embroidery pattern displayed on a display device.

2. Description of the Related Art

An embroidery sewing machine, such as a sewing machine with an embroidery function or an auto-embroidery machine, has a storage device that stores coordinate data of an embroidery pattern for each stitch ordinal number. When a trouble such as thread breaking or bobbin running out occurs during stitching of an embroidery pattern using such an embroidery sewing machine, the machine skips a few to a dozen of stitches from when the trouble is detected to when the machine stops.

To complete the embroidery pattern, the embroidery machine, while remaining inactive, needs to move only the embroidery frame to a coordinate position at a stitch ordinal number where the trouble, such as thread breaking, occurred.

In this case, the machine adjusts the resume position for the embroidery frame by repeating a reverse operation (frame reverse) in units of a few stitches in order to reverse the embroidery frame to the embroidery stitching resume position or by repeating a forward operation (frame forward) in units of a few stitches in order to forward the embroidery frame from the start point of the embroidery pattern to the embroidery stitching resume position.

A known embroidery sewing machine disclosed by Japanese Unexamined Patent Application Publication No. 1-223993, for example, is capable of reversing or forwarding the coordinate position of an embroidery frame by one stitch or an arbitrary number of stitches by pressing a frame reverse key or a frame forward key.

However, the user of the embroidery sewing machine disclosed by Japanese Unexamined Patent Application Publication No. 1-223993 is unable to see which position the coordinate position of the specified number of stitches is on the actual embroidery pattern, simply by specifying the number of stitches with the use of the frame reverse key or the frame forward key.

To solve this problem, a known embroidery sewing machine disclosed by Japanese Unexamined Patent Application Publication No. 8-57173, for example, enables the user to easily specify an embroidery stitching resume position while looking at an embroidery pattern displayed on a screen of a display device when embroidery stitching is interrupted by a trouble such as thread breaking, and to specify the embroidery stitching resume position while looking at the embroidery pattern enlarged and displayed, as needed, on the display device.

However, the embroidery sewing machine disclosed by Japanese Unexamined Patent Application Publication No. 8-57173 is incapable of accurately specifying the embroidery stitching resume position simply by enlarging and displaying the embroidery pattern on the display device when the embroidery pattern displayed on the screen of the display device includes a plurality of partial patterns (hereinafter referred to as "layers") and stitches in different layers or distant (in terms of the stitch ordinal number) stitches in the same layer are concentrated at a position to be specified.

In particular, as illustrated in FIG. 23A, to stitch an embroidery pattern including a first layer E and a second layer F which are adjacent to each other by forming mat-type stitches S1 and S2 in a horizontal direction, coordinate data for moving the embroidery frame in the X- and Y-directions is first adjusted to a sewn state illustrated in FIG. 23A. The actually sewn first layer E and second layer F pucker in the horizontal direction, and accordingly a gap G where there is no thread is generated between the first layer E and the second layer F, as schematically illustrated in FIG. 23B.

To prevent the gap G, the actually used coordinate data includes an overlap H where adjacent portions of the first layer E and the second layer F overlap, as illustrated in FIG. 23C. By including this overlap H, the gap G caused by puckering is resolved, and the embroidery pattern including the first layer E and the second layer F which are beautifully adjacent to each other is sewn, as illustrated in FIG. 23A.

When the overlap H included in the coordinate data is specified as the embroidery resume position, since the two layers E and F overlap to form the embroidery pattern, there is a need to appropriately display on the screen of the display device the resume position serving as a candidate from among concentrated stitches.

The user needs to pay careful attention to the position to touch on the embroidery pattern displayed on the screen in order to accurately specify the embroidery stitching resume position on the screen of the display device.

SUMMARY OF THE INVENTION

Accordingly, it is an object of the present invention to provide an embroidery sewing machine capable of accurately specifying an embroidery stitching resume position, even when stitches in different layers or distant (in terms of the stitch ordinal number) stitches in the same layer are concentrated at an embroidery stitching resume position specified by a user and when there are a plurality of needle position candidates based on a plurality of items of coordinate data at the specified position, by displaying a candidate list of the needle position candidates in the descending order of possibility and by selecting, by the user, an appropriate needle position from the candidate list.

According to an aspect of the present invention, there is provided an embroidery sewing machine that moves an embroidery frame, to which fabric is attached, in X- and Y-directions with respect to a needle reciprocating vertically at a fixed position, and that stitches an embroidery pattern. The embroidery sewing machine includes a storage device, an X-Y moving mechanism, a display device, a transparent touchscreen, a touch point detector, a coordinate data extracting unit, a coordinate data selecting unit, a candidate list display unit, and a coordinate data supplying unit. The storage device stores, for each stitch ordinal number, coordinate data of the embroidery pattern including a plurality of layers. The X-Y moving mechanism moves the embroidery frame in the X- and Y-directions on the basis of the coordinate data stored in the storage device. The display device displays the embroidery pattern on the basis of the coordinate data stored in the storage device. The transparent touchscreen is stacked on a front face of the display device. The touch point detector detects a position of touch on the touchscreen, the position being on the embroidery pattern displayed on the display device. The coordinate data extracting unit extracts coordinate data for each stitch ordinal number, the coordinate data being within a certain distance from the position of touch detected by the touch point detector. The coordinate data selecting unit selects a coordinate data candidate from the coordinate data extracted by the coordinate data extracting unit. The candidate list display unit lists a needle position candidate based on the coordinate data selected by the coordinate data selecting unit and displays the list on the display device. The coordinate data supplying unit supplies, when any needle position is specified from the needle position candidate displayed on the display device by the candidate list display unit, the X-Y moving mechanism with coordinate data of the specified needle position, and moves the embroidery frame to the needle position.

The coordinate data selecting unit may include a comparator that compares items of coordinate data extracted by the coordinate data extracting unit to determine whether coordinate data serving as a candidate and to-be-compared coordinate data are in different layers or, even when the items of coordinate data are in an identical layer, whether the items of coordinate data are distant from each other by a certain number of stitches or more. The candidate list display unit may include a tabular form display unit that displays the needle position candidate in a tabular form classified by item.

The coordinate data supplying unit may include: a needle position specifying unit that specifies any needle position from the needle position candidate displayed on the display device by the candidate list display unit; and a needle position display unit that displays the needle position specified by the needle position specifying unit on the display device. The needle position display unit may include a representation changing unit that changes a representation displayed on the display device before and after the needle position specified by the needle position specifying unit. The embroidery sewing machine may further include a touch point display unit that displays, on the embroidery pattern displayed on the display device, the position of touch detected by the touch point detector.

The embroidery sewing machine according to the aspect of the invention is capable of not only moving the embroidery frame, which is inactive, to a to-be-specified resume position by directly touching a position that the user wants to specify on the embroidery pattern displayed on the display device, but also, even when stitches in different layers or distant (in terms of the stitch ordinal number) stitches in the same layer are concentrated at a to-be-specified resume position, displaying a list of needle positions based on coordinate data serving as candidates in the descending order of possibility and accurately specifying an embroidery stitching resume position by selecting, by the user, an appropriate needle position from the displayed needle position candidates.

BRIEF DESCRIPTION OF THE DRAWINGS

FIG. 1 is a perspective view illustrating the appearance of an embroidery sewing machine according to an embodiment;

FIG. 16A illustrates a touched dot and dots serving as candidates and FIG. 16B illustrates an example of the needle position based on the position of touch and coordinate data;

FIGS. 18A and 18B are conceptual diagrams illustrating the structure of a table where data on a stitch of every counter value is held, namely, FIG. 18A illustrates a state before sorting and FIG. 18B illustrates a state after sorting;

FIGS. 19A to 19C are diagrams illustrating the state of the table when comparison between a stitch of a counter value and subsequent stitches is performed, namely, FIG. 19A illustrates a first loop, FIG. 19B illustrates a second loop, and FIG. 19C illustrates a third loop;

FIG. 23A illustrates a sewn state serving as a goal, FIG. 23B illustrates a state where the portions pucker, and FIG. 23C illustrates a state where stitch data includes an overlap portion in order to take this puckering into consideration.

DESCRIPTION OF THE PREFERRED EMBODIMENTS

Figure 2:
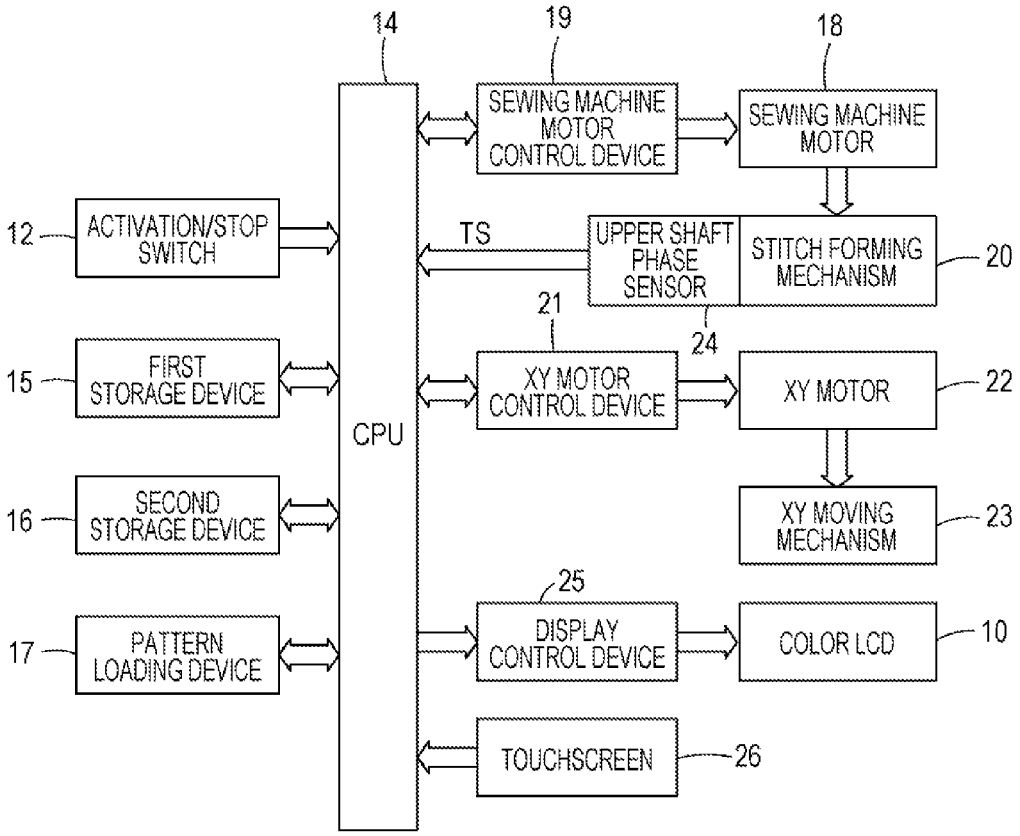
FIG. 2 is a block diagram illustrating the electrical configuration of the embroidery sewing machine according to the embodiment.

Next, an embroidery sewing machine according to an embodiment of the present invention will be described with reference to the attached drawings.

Embodiment

The following description refers the vertical direction as "up and down", a direction from the lower left to the upper right as "left and right", and a direction from the lower right to the upper left as "front and back" when seen on a perspective view illustrated in FIG. 1. The following description may further refer the left and right direction as "X", and the front and back direction as "Y".

The embodiment applies the present invention to a zigzag sewing machine with an embroidery device, to which an embroidery frame is detachably attached in order to stitch various embroidery patterns.

Referring to FIG. 1, a sewing machine main body M includes a lower bed 1, a leg column 2 standing from the right end of the bed 1, an arm 3 extending leftward from the top of the leg column 2 so as to face the bed 1, and a head 4 provided at the left end of the arm 3.

The bed 1 contains a carriage 5, and an X-Y moving mechanism that reciprocates an embroidery frame 6 attached to the carriage 5 in the X- and Y-directions.

The embroidery frame 6 is provided with a clump knob 7 at an end thereof, and the clump knob 7 is detachably attached to the carriage 5 of the X-Y moving mechanism.

The head 4 includes a needle bar (not illustrated), which is a stitch forming mechanism, and a needle 9, which are provided at the bottom of the head 4 facing downward.

After fabric serving as an object subjected to embroidery is attached to the embroidery frame 6, the embroidery frame 6 is attached to the carriage 5 by the clump knob 7. The embroidery frame 6 is moved in the X- and Y-directions with respect to the vertical reciprocating motion of the needle 9, resulting in an embroidery pattern being stitched.

A color liquid crystal display (LCD) display device 10 is located on the front face of the leg column 2. The color LCD display device 10 is a display device that displays a selected embroidery pattern and various function keys. The color LCD display device 10 also serves as a touchscreen. An upper left area of the color LCD display device 10 is a pattern display window 11 that graphically renders the selected embroidery pattern.

For example, when the pattern display window 11 has 200 by 200 dots, which are part of the color LCD display device 10, a 200×200 mm pattern is displayed in such a manner that one liquid crystal dot displays stitch data for 1 mm. Likewise, a 100×100 mm pattern is displayed in such a manner that one dot displays stitch data for 0.5 mm.

An activation/stop switch 12 that activates and stops the sewing machine is located on the front face of the head 4.

When performing embroidery stitching, the zigzag sewing machine with the embroidery device according to the embodiment is capable of selecting an embroidery stitching mode with the use of a stitching mode selection key (not illustrated) among the function keys on the color LCD display device 10. When performing no embroidery stitching, the zigzag sewing machine with the embroidery device enters a normal stitching mode and performs normal stitching by vertically reciprocating the needle 9 and forwarding the fabric with the use of a feed dog (not illustrated).

A control system of the zigzag sewing machine with the embroidery device according to the embodiment is configured as illustrated in the block diagram of FIG. 2. A central processing apparatus (CPU) 14 is connected to a first storage device 15 including a read-only memory (ROM) and a second storage device 16 including a random-access memory (RAM) through an input/output (I/O) bus.

The CPU 14 is further connected to a pattern loading device 17 having a card slot into which a recording medium such as a ROM card is inserted. The recording medium in the pattern loading device 17 stores pattern data of a plurality of types of embroidery patterns, which are classified by type and associated with pattern code numbers.

Figure 3:
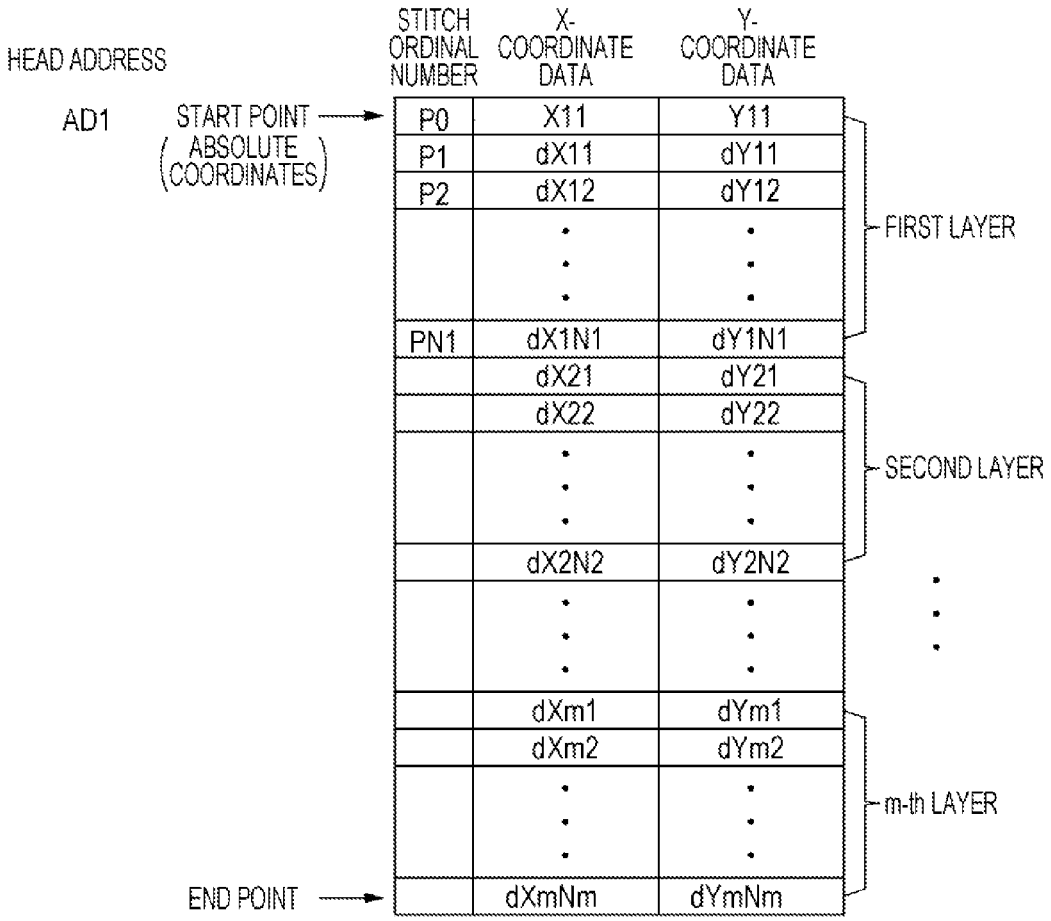
FIG. 3 is a conceptual diagram illustrating the structure of pattern data on a storage area.

Each embroidery pattern includes a plurality of layers with different thread colors. FIG. 3 schematically illustrates the pattern data of an exemplary embroidery pattern. The pattern data of each layer is stored in the recording medium in the order of the first layer, second layer, . . . , and m-th layer in accordance with the order of stitching.

The pattern data of each layer is stored as X-coordinate data and Y-coordinate data (hereinafter the X-coordinate data and Y-coordinate are collectively referred to as "coordinate data") for moving the embroidery frame 6 for each stitch ordinal number and specifying the coordinates of a needle drop position.

Note that the coordinate data which specifies the needle drop position of the embroidery pattern is such that only the 0-th stitch, which is the start point, is the absolute coordinate position, and each of stitches from the 1-st stitch onward to the end point is a relative coordinate position from the immediately preceding coordinates.

The first storage device 15 stores a sewing machine motor control program for driving a sewing machine motor 18, a display control program for displaying various function keys on the color LCD display device 10, a pattern form display control program for displaying a selected embroidery pattern on the color LCD display device 10 on the basis of coordinate data of the embroidery pattern, an embroidery stitching control program for controlling an XY motor 22 on the basis of the coordinate data, and a later-described candidate list display control program, which accompanies the embroidery stitching control program and which is specific to the embodiment of the present invention.

Since control other than the candidate list display control, which is specific to the present application, is general sewing machine control, a description thereof will be omitted.

The second storage device 16 includes a head address memory that stores a head address AD1 illustrated in FIG. 3, for example, for coordinate data of each of the above-mentioned plurality of types of embroidery patterns, a pointer that specifies the address AD1 of the head address memory, for example, a counter that temporarily stores the result of an arithmetic operation performed by the CPU 14, and a buffer.

Using the sewing machine motor control program, the CPU 14 controls a sewing machine motor control device 19 to rotate the sewing machine motor 18, and drives a stitch forming mechanism 20 to form stitches.

The stitch forming mechanism 20 includes the needle 9, as illustrated in FIG. 1, and a thread hooker such as a horizontal bobbin case (not illustrated), and is configured to form lockstitches.

The second storage device 16 loads coordinate data for stitching various embroidery patterns from the pattern loading device 17. An arbitrary embroidery pattern and its size are selectable with the use of a pattern selection key (not illustrated) displayed on the color LCD display device 10.

With the use of an embroidery position specifying key (not illustrated), the position for stitching an embroidery pattern is also specifiable.

The CPU 14 drives the XY motor 22 using an XY motor control device 21 on the basis of the coordinate data loaded to the second storage device 16, and moves an X-Y moving mechanism 23 in the X- and Y-directions.

Referring back to FIG. 1, the X-Y moving mechanism 23 includes the carriage 5 to which the clump knob 7 is attached. Fabric is attached to the embroidery frame 6 attached to the carriage 5, and this fabric is moved in the X- and Y-directions to perform embroidery stitching.

An upper shaft phase sensor 24 detects the rotation phase of an upper shaft (not illustrated) of the sewing machine main body M, detects the vertical reciprocating motion of the needle 9, and generates a timing signal TS. The timing signal TS is used to match the timing of driving the X-Y moving mechanism 23 with the use of the XY motor 22 and the vertical reciprocating motion of the needle 9.

On receipt of the timing signal TS, the CPU 14 synchronizes with the signal TS and controls the XY motor control device 21 at a time point at which the needle 9 withdraws from the fabric, thereby driving the XY motor 22.

Since the color LCD display device 10 also serves as a touchscreen as has been described above, a transparent touchscreen 26 is stacked on the front face of the color LCD display device 10.

The touchscreen 26 is of analog type including two glass or film substrates, an upper one and a lower one, and a transparent electrode is formed on the entirety of the glass or film substrates. The touchscreen 26 may be of any type as long as it is capable of detecting a position in response to a pressing force applied to the surface of the substrate. A touchscreen of analog type has a simple structure and is inexpensive.

On receipt of an operation position signal from the touchscreen 26, the CPU 14 controls a display control device 25 to perform various displays related to an embroidery pattern on the color LCD display device 10, and, along with the touchscreen 26, to display various function keys such as the stitching mode selection key.

The CPU 14 further displays a needle position with respect to an embroidery pattern graphically displayed on the color LCD display device 10 through the display control device 25 on the basis of the touch position information from the touchscreen 26.

As has been described above, the embroidery sewing machine according to the embodiment drives the XY motor 22 with the use of the XY motor control device 21 on the basis of the above-mentioned coordinate data, and, with cooperation between the movement in the X- and Y-directions of the X-Y moving mechanism 23 with the use of the XY motor 22 and the vertical reciprocating motion of the needle 9, forms an embroidery pattern on the fabric attached to the embroidery frame 6.

Next, the use modes and operational advantages of the embodiment will be described in terms of the method of specifying the needle position at the start of stitching, using three examples including the present embodiment and the following first and second reference examples.

First Reference Example

Figure 4:
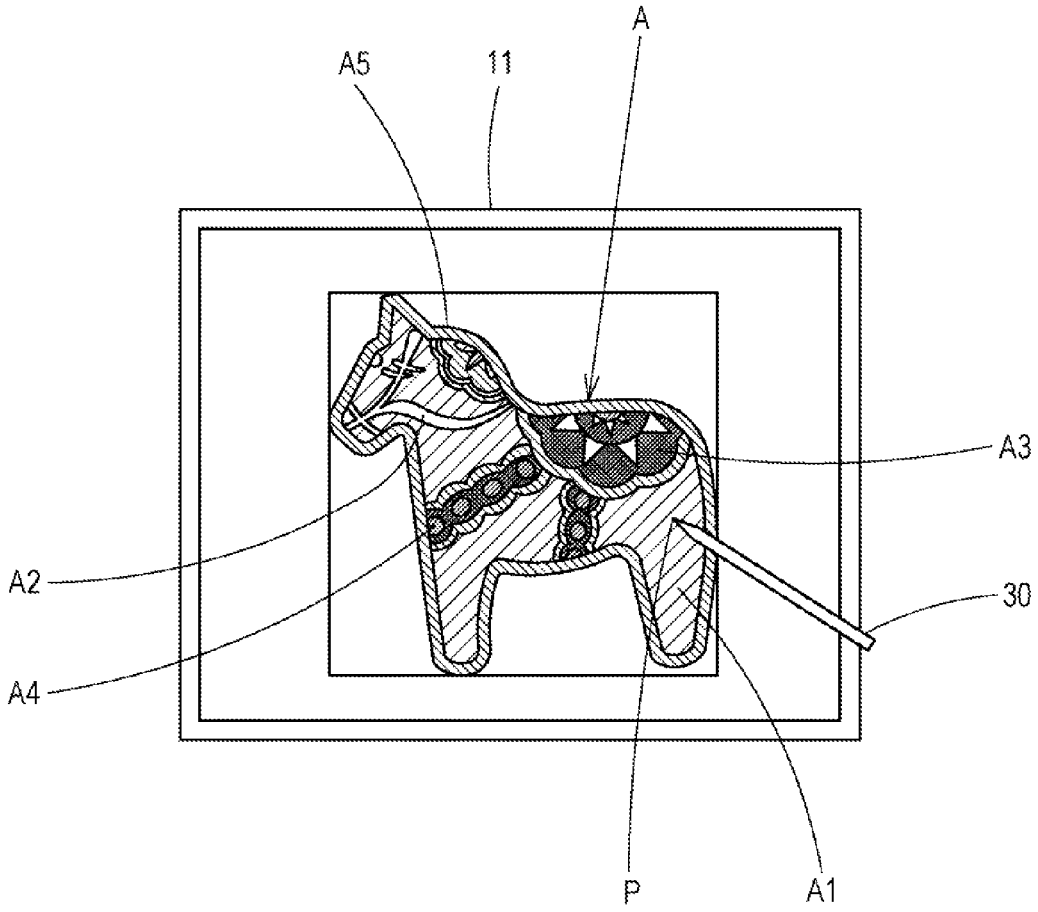
FIG. 4 is a diagram illustrating a display state of a horse embroidery pattern displayed on a display device.

In the first reference example, it is assumed that an embroidery pattern is loaded from the pattern loading device 17 illustrated in FIG. 2, and, for example, as illustrated in FIG. 4, a horse embroidery pattern A is displayed in the pattern display window 11 of the color LCD display device 10.

The horse embroidery pattern A includes five layers, namely, a first layer A1, a second layer A2, a third layer A3, a fourth layer A4, and a fifth layer A5. A point P that a stylus 30, illustrated in FIG. 4, touches is the first layer A1.

In general, an embroidery pattern includes different layers that overlap each other. Since the first layer A1 is stitched at first, a pattern of no other layer is stitched before and under the pattern of the first layer A1.

Figure 5A:
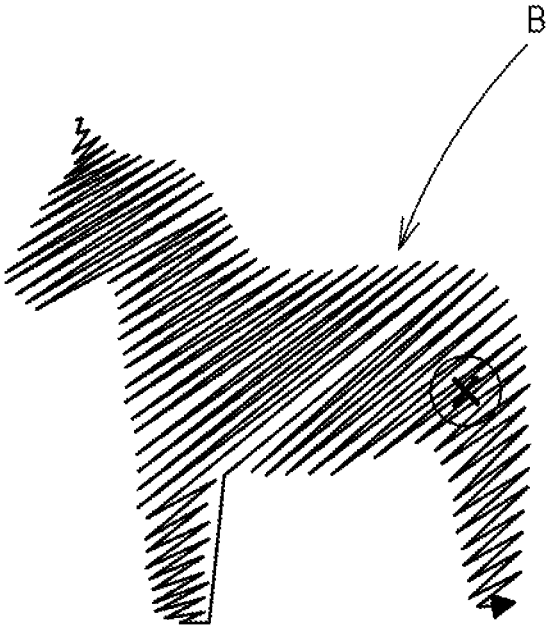
FIGS. 5A and 5B illustrate a first layer of the horse embroidery pattern, namely, FIG. 5A displays the order of stitching and FIG. 5B displays an enlarged main portion.

FIG. 5A illustrates the order of stitching the first layer A1. When all the actual needle drop positions are illustrated, the result becomes a completely black image. To prevent this, some stitches are skipped to obtain an image B.

Figure 5B:
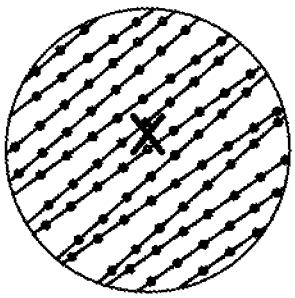

The order of stitching with the thread color of the first layer A1 is as follows: to fill the pattern in the form of a horse silhouette from the tip of an ear at the upper left toward the lower right, the pattern is stitched in zigzags with a large swing width while turning back at the contour of the horse. As illustrated in an enlarged image in FIG. 5B, the first layer A1 is mat-stitched, not satin-stitched. Needle drop positions are formed during a straight stitch as needed, as indicated by black dots, and the stitch ends at the tip of a hind leg at the lower right.

In this case, when a failure such as thread breaking is found at a time point at which the first layer A1 of the horse embroidery pattern A displayed in the pattern display window 11 is completely stitched, the case of specifying the needle position for starting stitching immediately before the thread break by directly touching the pattern display window 11 will be described.

Figure 6:
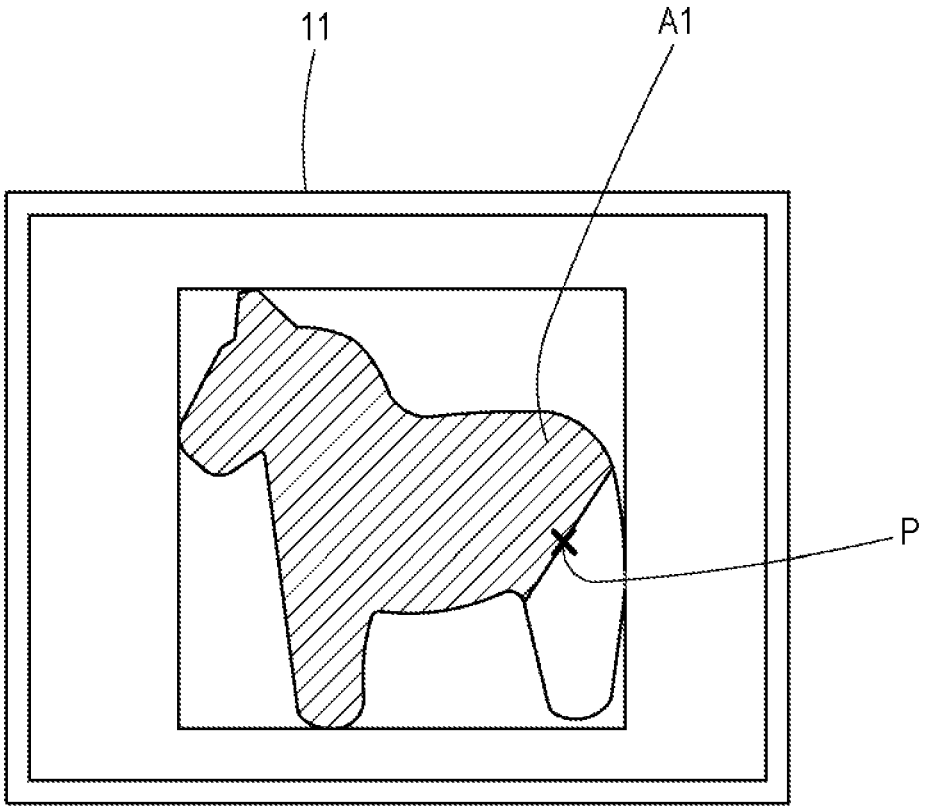
FIG. 6 is a diagram illustrating an embroidery stitching resume position for the first layer displayed on the display device.

When the horse embroidery pattern A displayed in the pattern display window 11 of the color LCD display device 10 whose front face is laminated with the transparent touchscreen 26 is touched with the stylus 30, as illustrated in FIG. 6, the point P the user touches with the stylus 30 is marked with "x". In doing so, the position at which "x" is displayed immediately becomes the stitching start needle position. Of the pattern of the first layer A1 displayed in the pattern display window 11, a portion before the stitching start needle position (stitched portion) is represented in color, and a portion after the stitching start needle position (to-be-stitched portion) is represented in white.

That is, a representation of the displayed embroidery pattern is changed before and after the stitching start needle position.

In this reference example, portions before and after the stitching start needle position are represented using the presence and absence of color of the first layer A1. Alternatively, a portion after the needle position may be colored with a light color, hatched, made semi-transparent, or made monochrome.

In the example illustrated in FIG. 6, the point P touched with the stylus 30, at which "x" is displayed, has no overlapping layers or is not a boundary between layers. Furthermore, as illustrated in FIG. 5A, the touched portion is not stitched a plurality of times in the first layer A1.

Therefore, it is unlikely that the point P touched by the user is greatly displaced from a targeted needle position.

When the horse embroidery pattern A displayed in the pattern display window 11 is touched with the stylus 30, the needle position is immediately confirmed, and the display is switched to that illustrated in FIG. 6.

If the position of touch is slightly off the targeted needle position, the needle position is adjustable using a frame reverse key and/or a frame forward key of the related art.

Furthermore, the embroidery pattern displayed in the pattern display window 11 may be enlarged to enable the user to more accurately specify the needle position again, as will be described later.

In the above-described case where there is one touch candidate, a mode of moving the embroidery frame 6 and resuming embroidery stitching from a desired stitching start needle position when the user directly touches the embroidery pattern displayed in the pattern display window 11 with the stylus 30 will be described using the flowchart illustrated in FIG. 7.

Firstly, to wait for an embroidery pattern to be selected, it is determined in step S1 whether "there is any embroidery pattern". Since an embroidery pattern is loaded from the pattern loading device 17 and the horse embroidery pattern A is selected in this example, it is determined "Yes", and the process proceeds to step S2.

Next in step S2, if the sewing machine is active, to wait for the sewing machine to stop (there is no need to wait before stitching is started or when stitching is completed), it is determined whether the sewing machine has "stopped stitching". Since the sewing machine has stopped stitching in this example, it is determined "Yes", and the process proceeds to step S3.

Next in step S3, to wait for the user to specify the stitching start needle position on the embroidery pattern displayed in the pattern display window 11, it is determined whether "the displayed pattern is touched". Since the user touches the horse embroidery pattern A displayed in the pattern display window 11 with the stylus 30 in this example, as illustrated in FIG. 4, it is determined "Yes", and the process proceeds to step S4.

Next in step S4, to display the needle position touched on the embroidery pattern displayed in the pattern display window 11, as illustrated in FIG. 6, the point P the user touches is marked with "x", the color is changed before and after the position at which "x" is displayed (stitching start needle position), and the process proceeds to step S5.

Next in step S5, the sewing machine remains inactive, and only the embroidery frame 6 is moved from the current position (end position) to the user-specified needle position.

Second Reference Example

Next in the second reference example, when distant stitches in the same layer or stitches in different layers are concentrated, the procedure for the user to specify a targeted needle position will be described.

Figure 8:
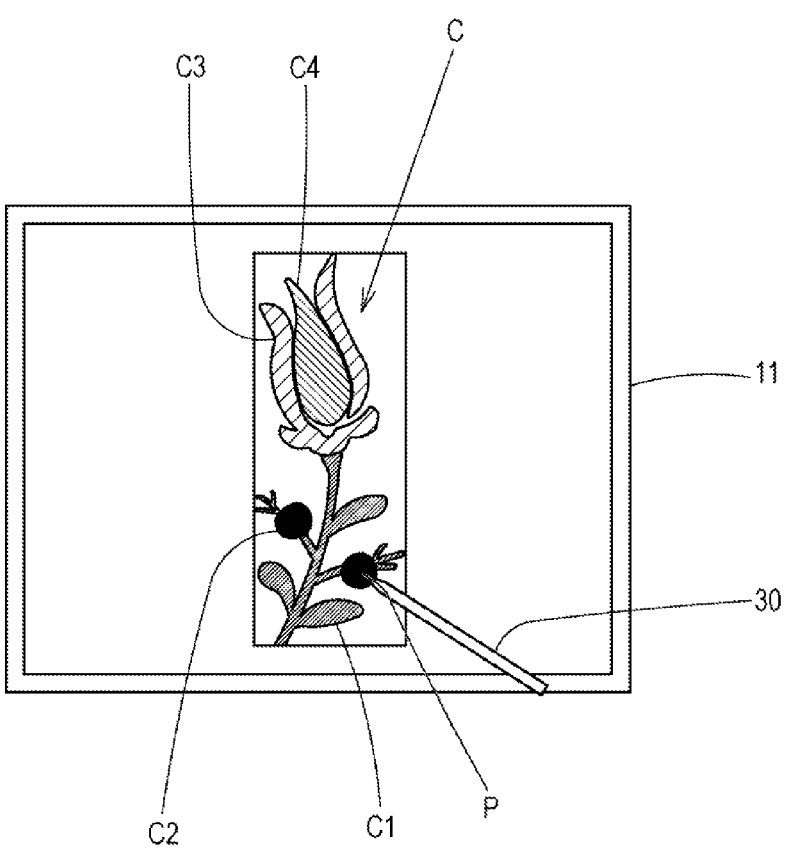
FIG. 8 is a diagram illustrating a display state of a flower embroidery pattern displayed on the display device.

In this reference example, it is assumed that an embroidery pattern is loaded from the pattern loading device 17 illustrated in FIG. 2, and a flower embroidery pattern C illustrated in FIG. 8 is selected as an embroidery pattern and is displayed in the pattern display window 11.

The flower embroidery pattern C includes four layers, namely, a first layer C1, a second layer C2, a third layer C3, and a fourth layer C4.

As illustrated in FIG. 8, the point P the user touches with the stylus 30 is a portion where the first layer C1 and the second layer C2 overlap.

Figure 9:
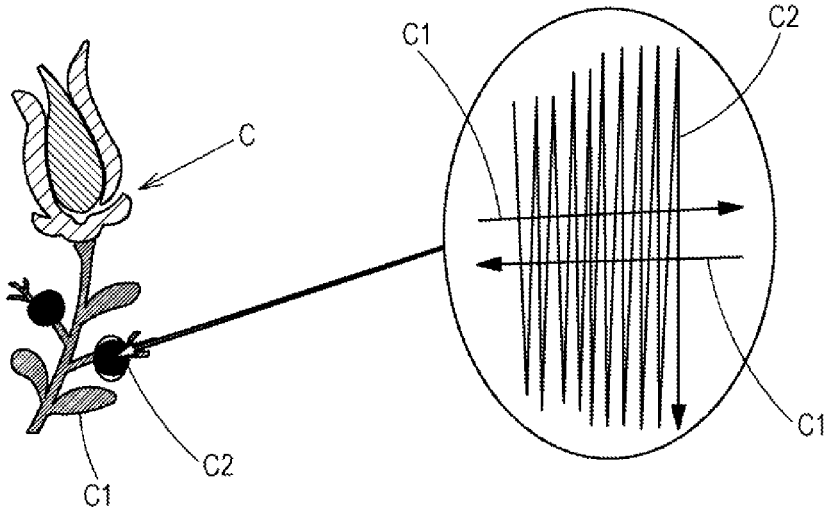
FIG. 9 is an enlarged view illustrating the direction of stitching near the position of touch on the embroidery pattern.

In this case, when a portion around the point P touched with the stylus 30 is enlarged, the portion has a stitch configuration as schematically illustrated in the eclipse of FIG. 9.

That is, a branch portion is stitched in a satin stitch with a small swing width from left to right, using the thread color of the first layer C1. When the needle comes to a portion that overlaps the second layer C2, a straight stitch is formed up to the tip of the branch. When the stitch up to the tip of the branch is completely stitched, the needle turns back, and a satin stitch is formed leftward from the tip with a small swing width. When the needle again comes to the portion overlapping the second layer C2, a straight stitch is formed from right to left.

When the first layer C1 is completely stitched and the sewing machine stops, to stitch a fruit portion, the needle thread is changed to the thread color of the second layer C2, a mat stitch is formed in zigzags with a great swing width from left to right.

In this manner, the thread of the second layer C2 is sewn over the thread of the first layer C1. In the flower embroidery pattern C displayed in the pattern display window 11, the thread of the first layer C1 hidden beneath the thread of the second layer C2 is unseen.

Therefore, the point P touched with the stylus 30 on the flower embroidery pattern C in this example is one of the following: (a) "a straight stitch from left to right of the first layer C1"; (b) "a straight stitch from right to left of the first layer C1"; and (c) "a mat stitch in zigzags from left to right of the second layer C2".

In this reference example, when a failure such as thread breaking is found at a time point at which the second layer C2 is completely stitched, the case of specifying the needle position for starting stitching immediately before the thread break by directly touching the flower embroidery pattern C displayed in the pattern display window 11 will be described.

As illustrated in FIG. 8, the flower embroidery pattern C displayed in the pattern display window 11 is touched with the stylus 30 to specify a desired stitching start needle position.

The touched needle position becomes the stitching start position, and the pattern display window 11 changes its display before and after the stitching start needle position. Since stitches in different layers (the first layer C1 and the second layer C2) and distant (in terms of the stitch ordinal number) stitches in the same layer (a straight line from left to right and a straight line from right to left of the first layer C1) are close to one another, it is necessary to enlarge and display a portion near the portion the user touches, as illustrated in FIG. 10.

Figure 10:
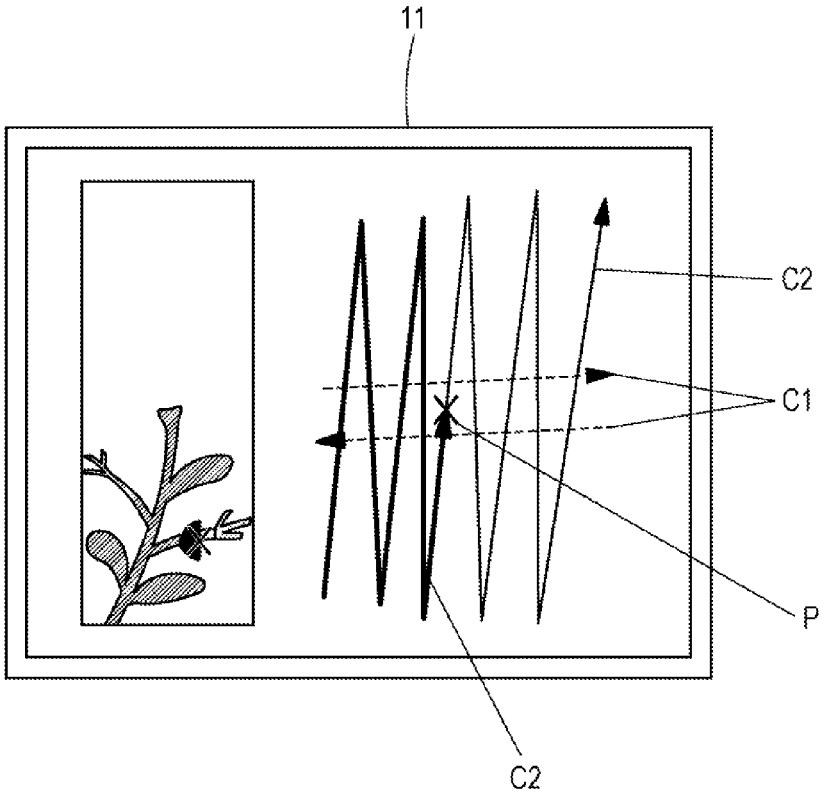
FIG. 10 is a display example of the display device which switches its display before and after a needle position at the start of stitching.

In the example illustrated in FIG. 10, the touch point P is marked with "x", the first layer C1, which is an unselected candidate, is displayed by a dotted line, and the second layer C2, which is a selected candidate, is displayed by a solid line. In the second layer C2, a portion before the stitching start needle position (marked with "x") is represented by a bold line to indicate that this portion is "already stitched", and a portion after the stitching start needle position is represented by a thin line to indicate that this portion is "to be stitched".

Along with the display which changes the representation of stitches before and after the stitching start needle position, another needle position on the enlarged and displayed stitch can be touched again to switch the stitching start needle position to another candidate.

Figure 11:
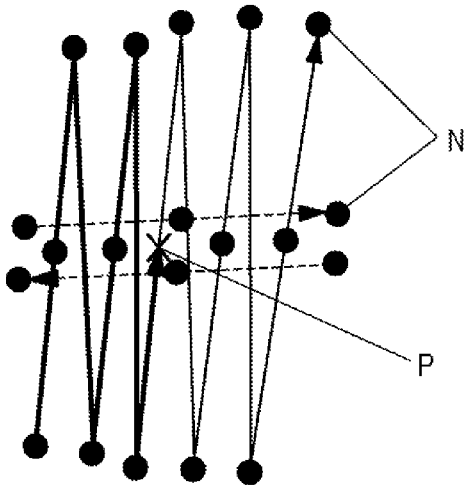
FIG. 11 is a diagram illustrating a display state of the embroidery pattern where a needle drop position is marked in FIG. 9.

FIG. 10 illustrates the enlarged and displayed stitch. What is actually touched to specify the stitching start needle position is one of the needle drop positions. Therefore, as illustrated in FIG. 11, each of the needle drop positions N may be marked with a black dot.

At this time point, if the touch point P is a needle position targeted by the user, this needle position may serve as a confirmed position to start stitching.

Figure 12:
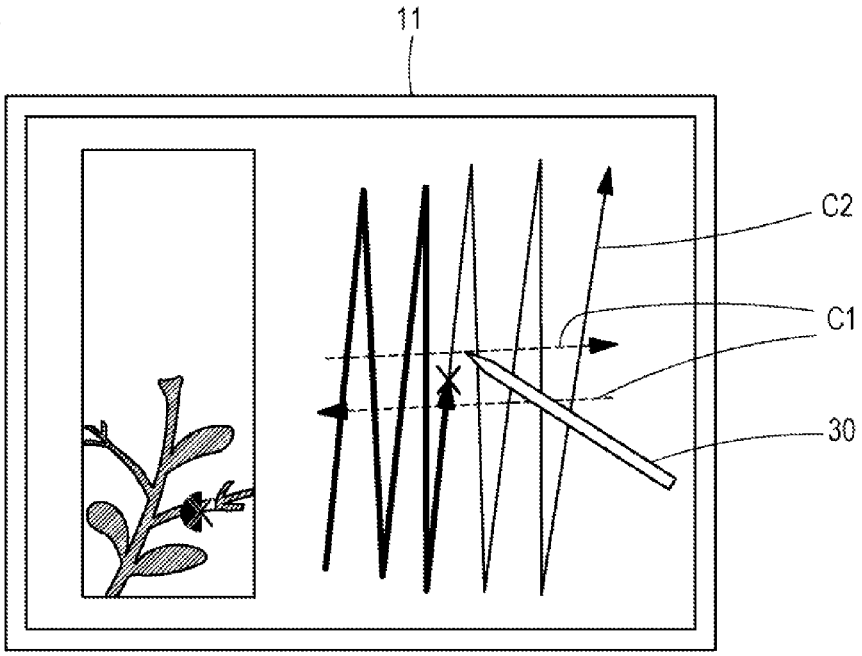
FIG. 12 is a diagram illustrating the case where the enlarged and displayed embroidery pattern is touched to specify the needle position.

If the touched needle position is different from a needle position that the user wants to specify, as illustrated in FIG. 12, the enlarged and displayed stitch is touched again with the stylus 30 to change the selected position.

In this case, since this portion is a detailed portion, it is easier for the user to touch an enlarged and displayed stitch. Needless to say, however, there is no problem in touching the original, not-enlarged embroidery pattern display to change the needle position.

Figure 13:
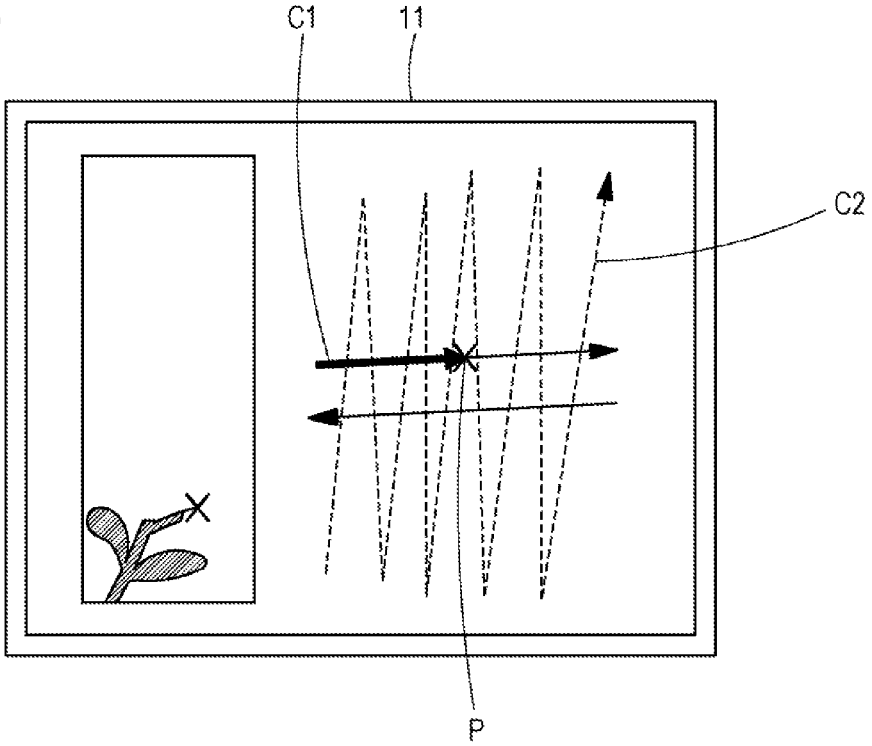
FIG. 13 is a display example of the display device which switches its display before and after the needle position at the start of stitching.

Because the finally touched needle position becomes the stitching start position, like the case where there is one touch candidate, the display of the pattern display window 11 is changed in such a manner that, as illustrated in FIG. 13, the second layer C2 is changed from a solid line to a dotted line, the first layer C1 is changed from a dotted line to a solid line, the point P touched on the first layer C1 is marked with "x", and the representation of the stitch before and after the stitching start needle position is changed.

Although the display is switched to an enlarged display after the embroidery pattern displayed in the pattern display window 11 is touched once in this reference example, the display may be an enlarged display from the beginning, or the user may switch between an enlarged display and a reduced display by using a function key displayed on the color LCD display device 10.

After specifying the rough needle position with this procedure, the more detailed needle position may be determined using a frame reverse or frame forward function of the related art.

Next, when stitches are concentrated, a mode of moving the embroidery frame 6 to the stitching start needle position and resuming embroidery stitching from a desired stitching start needle position by touching the enlarged embroidery pattern displayed in the pattern display window 11 with the stylus 30 will be described using the flowchart illustrated in FIG. 14.

Figure 7:
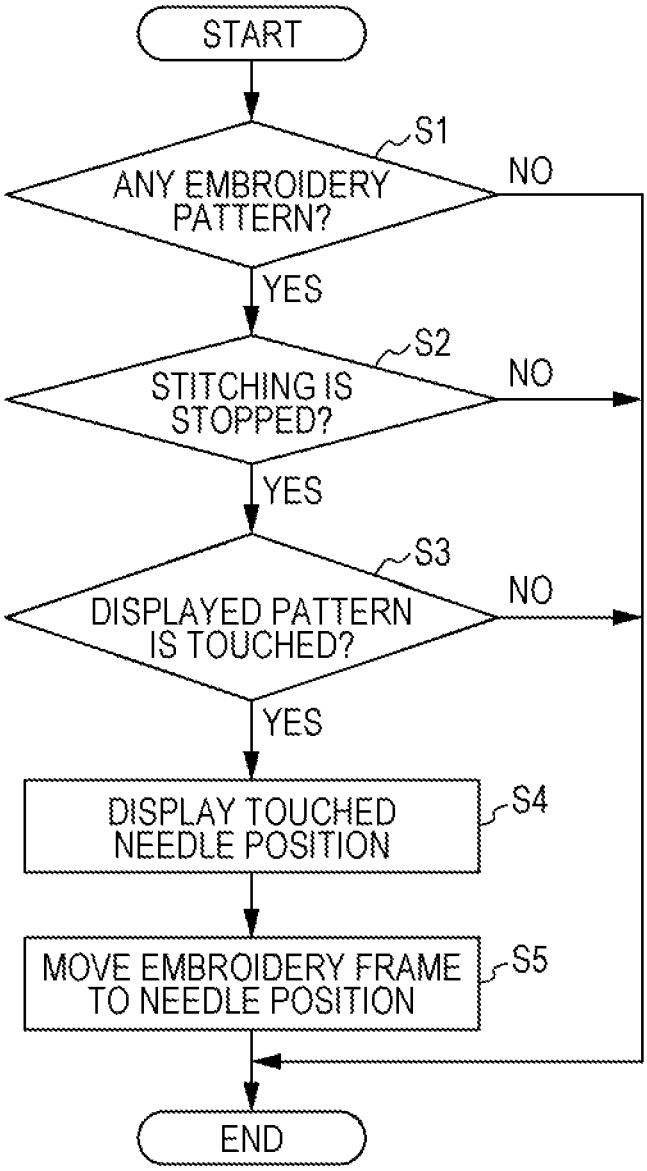
FIG. 7 is a flowchart illustrating a mode of moving an embroidery frame to a desired embroidery stitching resume position and resuming embroidery stitching when there is one touch position candidate.
Figure 14:
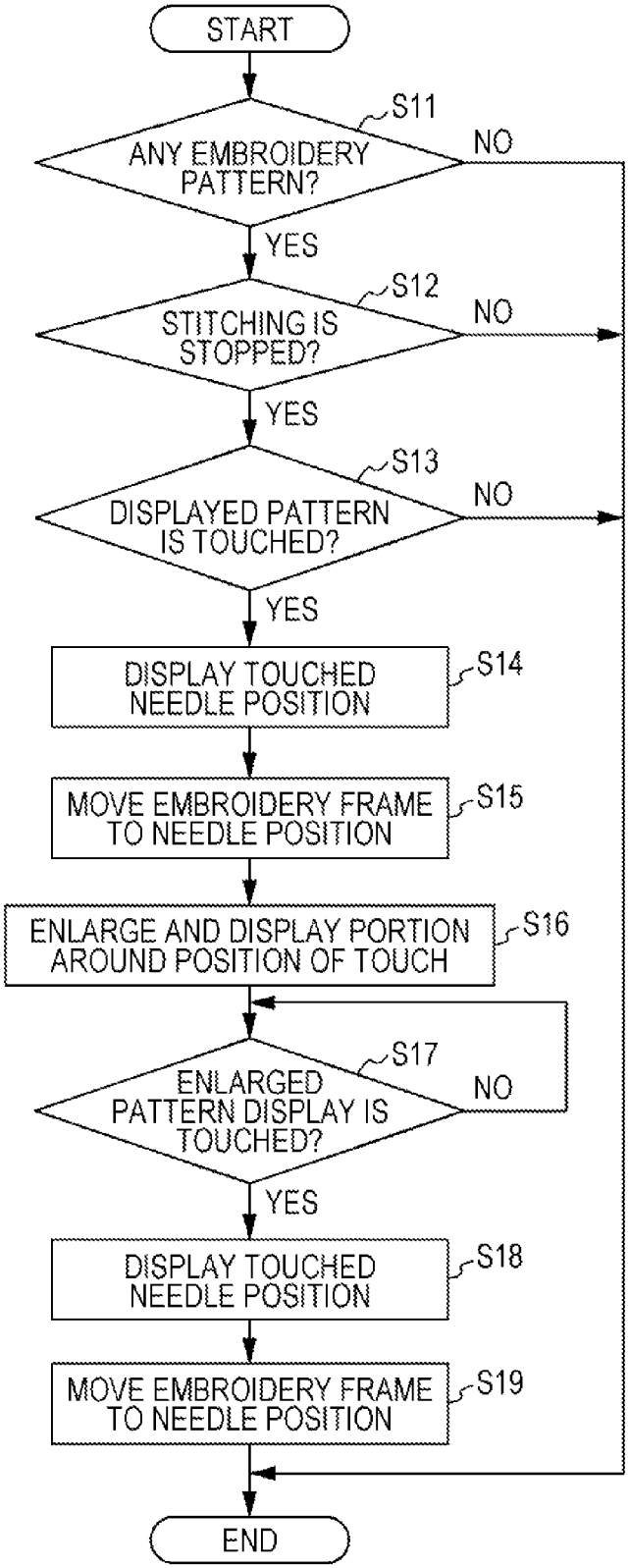
FIG. 14 is a flowchart illustrating a mode of moving the embroidery frame to a desired needle position based on an enlarged display and resuming embroidery stitching when stitches are concentrated at the position of touch.

Referring to FIG. 14, since steps S11 to S15 are the same as steps S1 to S5 illustrated in FIG. 7 in the above-described case where there is one touch candidate, descriptions thereof are omitted.

In step S16, since the position of touch on the embroidery pattern is a portion where stitches are concentrated, as illustrated in FIG. 10, a portion around the position of touch on the embroidery pattern displayed in the pattern display window 11 is enlarged and displayed, and the process proceeds to step S17.

Next in step S17, to wait for the user to touch somewhere in the enlarged portion displayed in the pattern display window 11 to select a needle position, it is determined whether "the enlarged pattern display is touched". When nowhere in the enlarged pattern display in the pattern display window 11 is touched, it is determined "No", and the process returns to step S17.

Again in step S17, when the user touches the enlarged pattern display, it is determined "Yes", and the process proceeds to step S18.

Next in step S18, to display the touched needle position, as illustrated in FIG. 10, the point P the user touches is marked with "x", the line thickness is changed before and after the position at which "x" is displayed (stitching start needle position), and the process proceeds to step S19.

Next in step S19, the sewing machine remains inactive, and only the embroidery frame 6 is moved from the current position (end position) to the user-touched needle position.

Embodiment

Next, a feature of the embodiment of the present invention will be described. That is, when distant (in terms of the stitch ordinal number) stitches in the same layer or stitches in different layers are concentrated, and when the user touches an embroidery pattern displayed in the pattern display window 11, a procedure of specifying a needle position that the user targets from a displayed candidate list will be described.

Figure 15:
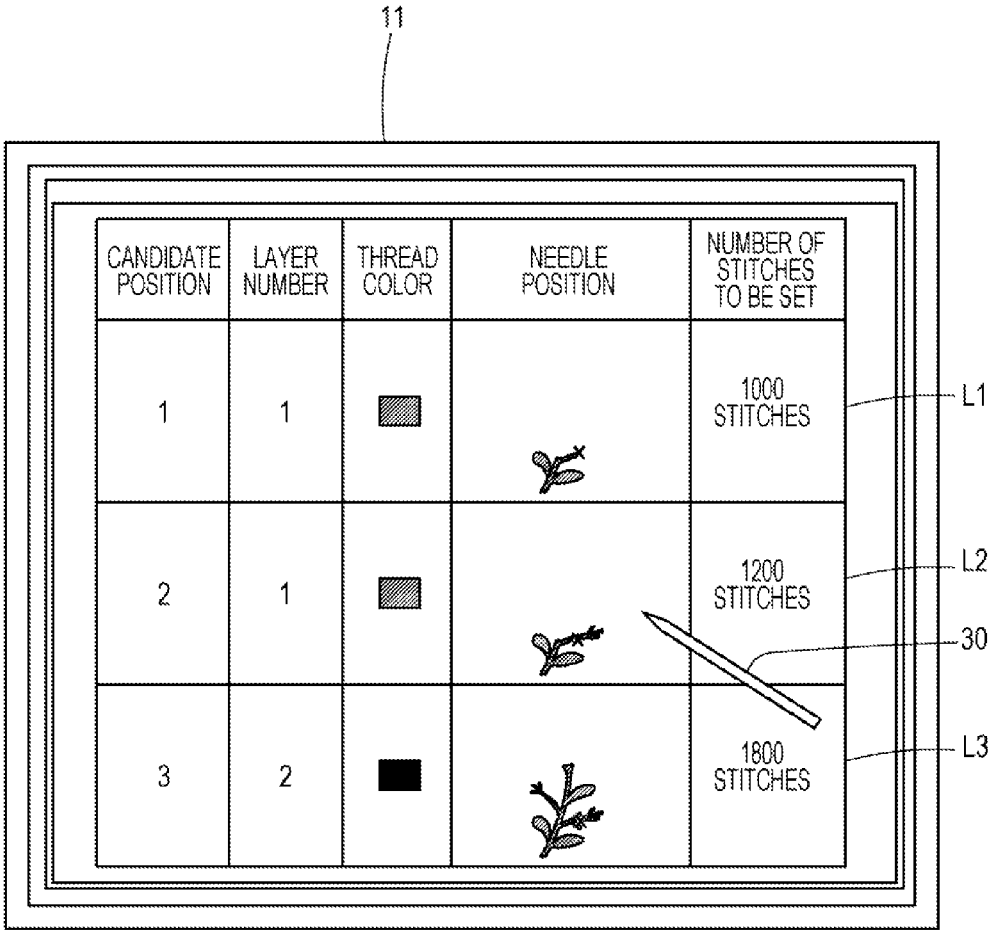
FIG. 15 is a diagram illustrating a candidate list displayed on the display device.

In this case, as illustrated in FIG. 8, when a needle position for starting stitching is touched with the stylus 30 on the flower embroidery pattern C displayed in the pattern display window 11 of the color LCD display device 10, for example, as illustrated in FIG. 15, a list of needle position candidates L1, L2, and L3 in accordance with the needle position that the user targets is displayed in the pattern display window 11.

In this embodiment, in a method of listing candidates for the needle position (coordinate data) that the user targets, a needle position serving as a candidate satisfies the following two conditions (a) and (b).

Figure 16A:
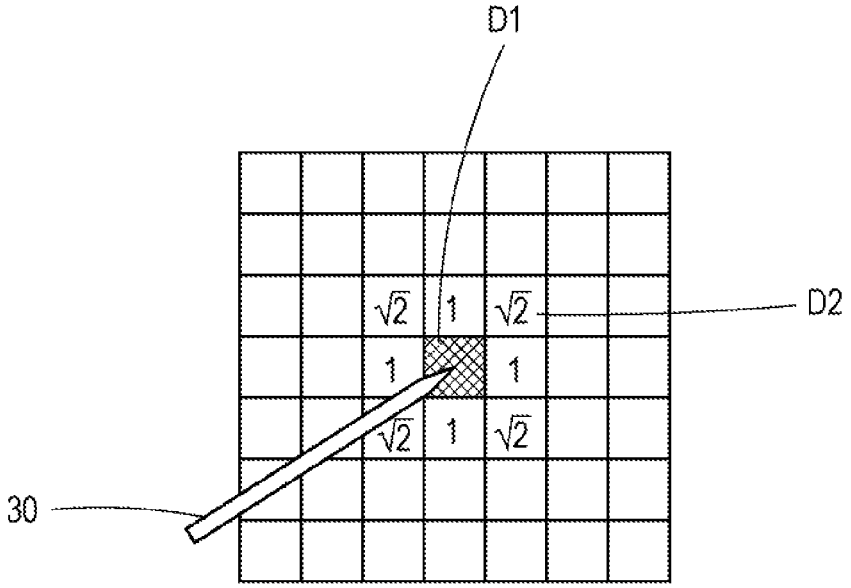
FIGS. 16A and 16B are diagrams illustrating liquid crystal dots of the display device, namely.

Condition (a): The needle position is within one dot from the position of a touched liquid crystal dot. The reason is that, even when the user accurately touches a liquid crystal dot corresponding to the needle position that the user targets, the touchscreen 26 has limited capability in terms of position detection resolution. As illustrated in FIG. 16A, this condition takes into consideration the possibility that the user has targeted not only a touched liquid crystal dot D1 whose position is detected by the touchscreen 26, but also liquid crystal dots D2 within one dot from the dot D1.

Figure 16B:
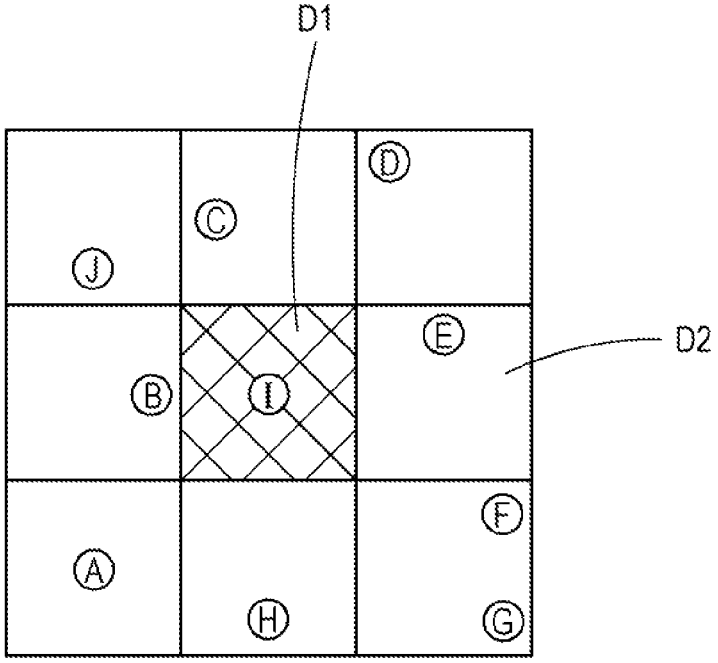

Condition (b): The layer of a candidate needle position is different from the layer of a to-be-compared needle position, or even in the same layer, the two needle positions are distant by fifty stitches or more. The reason is that the liquid crystal dot D1 whose position is detected by the touchscreen 26 and the liquid crystal dots D2 within one dot from the dot D1 may include ten needle positions A to J, as illustrated in FIG. 16B. Therefore, this condition is established to avoid an increase in the number of needle positions serving as candidates as much as possible.

In the case of an error of about fifty stitches from the needle position that the user targets, it does not take much time to move the embroidery frame 6 with the use of one-by-one stitch frame reverse or frame forward of the related art. Convenience is given higher priority over accuracy.

Next, when the user touches the embroidery pattern displayed in the pattern display window 11, as illustrated in FIG. 16B, if the liquid crystal dot D1, which is the position of touch detected by the touchscreen 26, and the dots D2 within one dot from the dot D1 include ten needle positions A to J, a specific example of the process of listing needle position candidates on the basis of the above-mentioned conditions (a) and (b) will be described using the flowchart illustrated in FIG. 17.

In step S21, when the touchscreen 26 is touched, as has been described above, the touchscreen 26, which is of analog type, performs analog-to-digital conversion on a voltage value (analog value) detected in accordance with the position of touch to obtain a digital value, and the process proceeds to step S22.

Next in step S22, the digital value obtained in accordance with the position of touch is converted to the liquid crystal dot position D1 illustrated in FIGS. 16A and 16B, and the process proceeds to step S23.

Next in step S23, a stitch counter in an area of the second storage device 16 which stores coordinate data of this embroidery pattern is set to the first stitch, and the process proceeds to step S24.

Next in step S24, coordinate data of the stitch counter (first stitch) is read, the read coordinate data is converted to a liquid crystal dot position, and the process proceeds to step S25.

Next in step S25, the distance between the dot position D1 touched on the touchscreen 26 and the dot position converted from the coordinate data of the stitch counter is calculated using the "distance formula between two points", and the process proceeds to step S26.

Next in step S26, a distance calculated for every stitch ordinal number of the stitch counter is held (stored) in a table storing items in the order of the counter value, as illustrated in FIG. 18A, and the process proceeds to step S27.

When the distance data is held in the table, the items "layer number" and "valid/invalid" are simultaneously held. In this case, the default state of the item "valid/invalid" is "valid".

Next in step S27, to calculate the above-described distance for all items of coordinate data of the embroidery pattern, it is determined whether the stitch counter indicates "the last stitch" on the basis of the stitch ordinal number data of the embroidery pattern loaded from the pattern loading device 17 to the second storage device 16. When the stitch counter does not indicate the last stitch, it is determined "No", and the process proceeds to step S28. In step S28, the stitch counter is incremented by one, the process returns to step S24, and the process up to step S26 is repeated.

Thereafter, when the stitch counter proceeds to the "last stitch", it is determined "Yes" in step S27, and the process proceeds to step S29.

Next in step S29, the distances held in the table illustrated in FIG. 18A are sorted in the ascending order of distance. As illustrated in FIG. 18B, the items of data in the table are updated and held in the ascending order of distance, and the process proceeds to step S30.

Next in step S30, the item "valid/invalid" of a stitch whose distance in the table illustrated in FIG. 18B exceeds $\sqrt{2}$ (the counter values from "11" onward) is updated from "valid" to "invalid", and the process proceeds to step S31.

Next in step S31, the counter in the table is set to "1" (beginning), and the process proceeds to step S32.

Next in step S32, it is determined whether the "the stitch of the counter value is valid", that is, whether the item "valid/invalid" of the stitch of the counter value in the table is "valid" or "invalid". In this case, as illustrated in FIG. 18B, the stitch of the counter value "1" is "valid". Accordingly, it is determined "Yes", and the process proceeds to step S33, which is the subroutine "comparison between the stitch of the counter value and subsequent stitches".

In the above-mentioned "comparison between the stitch of the counter value and subsequent stitches", for stitches that satisfy the above-mentioned condition (a), in the tables illustrated in FIGS. 19A to 19C, a stitch of the counter value is compared with each of subsequent to-be-compared stitches (of sub-counter values), thereby selecting a stitch that satisfies the above-mentioned condition (b) as a candidate.

Specifically, in the first loop of the table illustrated in FIG. 19A, the stitch of the counter value "1" is sequentially compared with subsequent stitches of the sub-counter values "2" to "10", the item "valid/invalid" of a stitch of one of the sub-counter values not satisfying the condition (b) is rewritten from "valid" to "invalid", and this stitch is removed from the candidates.

Figure 20:
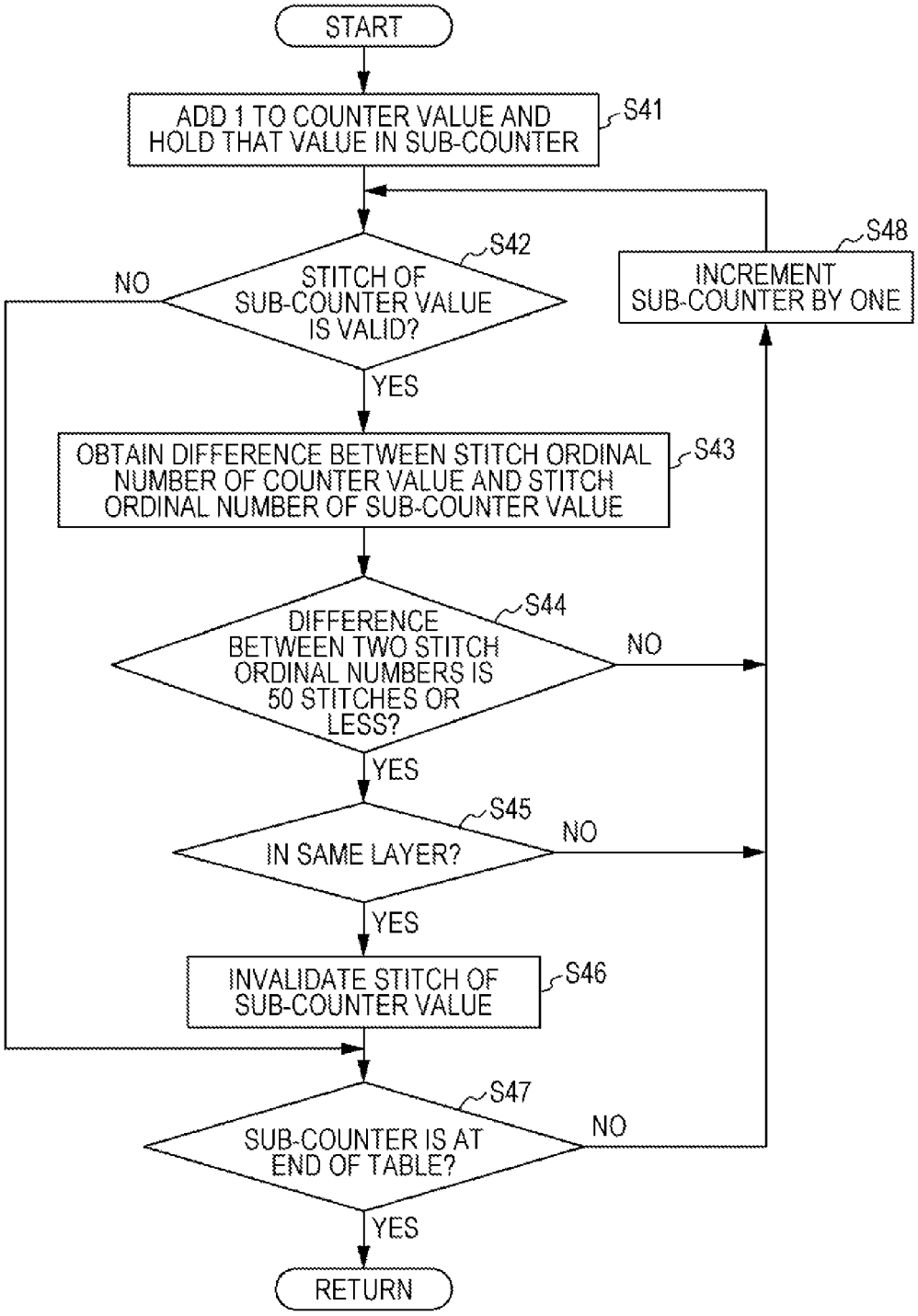
FIG. 20 is a flowchart illustrating the procedure of comparison between a stitch of a counter value and subsequent stitches.

This comparison is performed in accordance with the flowchart illustrated in FIG. 20.

In step S41, a value obtained by adding 1 to the counter value is held in the sub-counter, and the process proceeds to step S42. Since the counter value is "1" as illustrated in FIG. 19A, "2", which is obtained by adding 1 to the counter value, is held in the sub-counter.

Next in step S42, it is determined whether "a stitch of the sub-counter value is valid", that is, whether the item "valid/invalid" of a stitch of the sub-counter value in the table is "valid" or "invalid". Since a stitch of the sub-counter value "2" is "valid", it is determined "Yes", and the process proceeds to step S43.

Next in step S43, the difference between the stitch ordinal number of the counter value and the stitch ordinal number of the sub-counter value is obtained, and the process proceeds to step S44. In this case, the stitch ordinal number of the stitch of the counter value "1" is the "240-th stitch", and the stitch ordinal number of the stitch of the sub-counter value "2" is the "18-th stitch", and the difference between the two is "222 stitches".

Next in step S44, it is determined whether "the difference between the two stitch ordinal numbers is 50 stitches or less". Since the difference between the two stitch ordinal numbers is "222 stitches", it is determined "No", and the process proceeds to step S48.

Next in step S48, the sub-counter is incremented by one, and the process returns to step S42. In this case, the sub-counter "2" is incremented by one to be "3", and the process returns to step S42.

Next in step 342, since the stitch of the sub-counter value "3" is "valid", like the stitch of the sub-counter value "2", the process proceeds to steps S43, S44, and S48, the sub-counter "3" is incremented by one to be "4", and the process returns to step S42.

Next in step S42, since the stitch of the sub-counter value "4" is "valid", the process proceeds to step S43, the difference between the stitch ordinal number "240-th stitch" of the stitch of the sub-counter value "I" and the stitch ordinal number "203-rd stitch" of the stitch of the sub-counter value "4" is calculated to obtain "37 stitches", and the process proceeds to step S44.

Next in step S44, since "the difference between the two stitch ordinal numbers is 50 or less", it is determined "Yes", and the process proceeds to step S45.

Next in step S45, it is determined whether the stitches are in "the same layer". In this case, the layer of the stitch of the counter value "1" is 2, whereas the layer of the stitch of the sub-counter value "4" is 1. Accordingly, the stitches are in different layers, and it is determined "No". The process proceeds to step S48, the sub-counter value "4" is incremented by one to be "5", and the process returns to step S42.

Next in step S42, since the stitch of the sub-counter value "5" is "valid", like the stitch of the sub-counter value "4", the process proceeds to steps S43, S44, and S48, the sub-counter value "5" is incremented by one to be "6", the process returns to step S42, and the process up to step S44 or S45 is repeated.

Thereafter, when the sub-counter value reaches "10", in step S42, since the stitch of the sub-counter value "10" is "valid", as illustrated in FIG. 18B, the process proceeds to step S43, the difference between the stitch ordinal number "240-th stitch" of the stitch of the counter value "1" and the stitch ordinal number "241-st stitch" of the stitch of the sub-counter value "10" is calculated to obtain "1 stitch", and the process proceeds to step S44.

Next in step S44, since "the difference between the two stitch ordinal numbers is 50 or less", it is determined "Yes", and the process proceeds to step S45. In step S45, the layer of the stitch of the counter value "1" is 2, and also the layer of the stitch of the sub-counter value "10" is 2. Since the two stitches are in the same layer, it is determined "Yes", and the process proceeds to step 346.

Next in step S46, the stitch of the sub-counter value is invalidated. In this case, the item "valid/invalid" in the table of the stitch of the sub-counter value "10" is made "invalid", and the process proceeds to step S47.

Next in step S47, it is determined whether the sub-counter is at the end of the table, that is, whether the sub-counter reaches the last counter value in the table. Since the sub-counter is holding "10", it is determined "No", the process proceeds to step S48, "10" held in the sub-counter is incremented by one to be "11" in step S48, and the process returns to step S42.

As illustrated in FIG. 18B, since the item "valid/invalid" in the table of the stitches from the counter value "11" onward is "invalid", it is determined "No" in step S42 for the stitches of the sub-counter values "11" onward, and the process proceeds to step S47.

Thereafter, since it is determined "No" in step S47 until the sub-counter reaches the end of the table, the process going through S48 and S42 and returning to step S47 is repeated.

When the sub-counter finally reaches the end of the table, it is determined "Yes" in step S47, and the first loop of the table illustrated in FIG. 19A ends.

Figure 17:
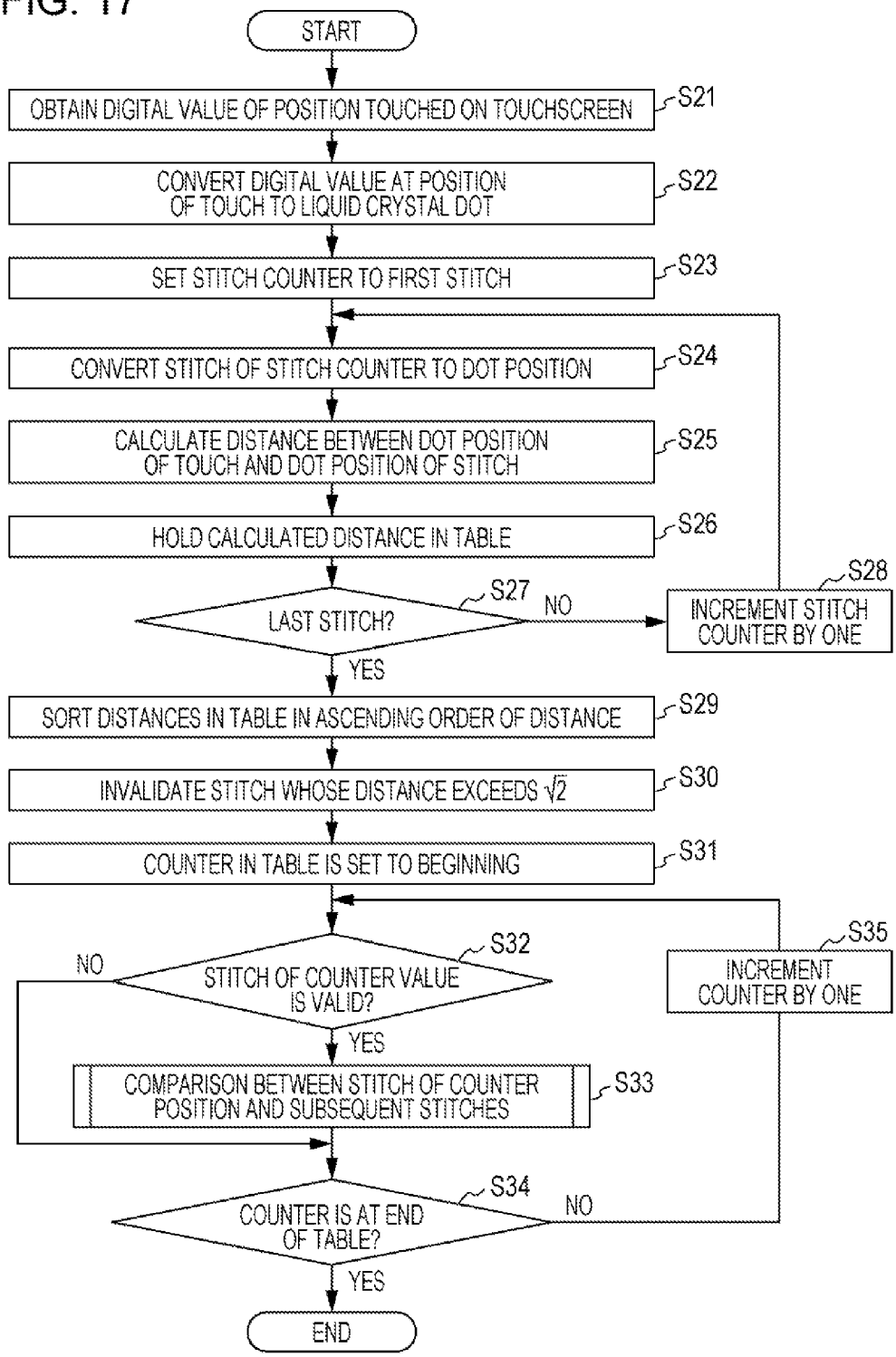
FIG. 17 is a flowchart illustrating the procedure of a process of listing needle position candidates.

Accordingly, the sub-routine S33 illustrated in the flowchart of FIG. 17 ends, and the process proceeds to step S34.

Next in step S34, it is determined whether the counter is at the end of the table. Since the counter value is "1", it is determined "No", the process proceeds to step S35, "1" held in the counter is incremented by one to be "2" in step S35, and the process returns to step S32.

Next in step S32, it is determined whether "a stitch of the counter value is valid". In this case, as illustrated in FIG. 19B, since the stitch of the counter value "2" is "valid", it is determined "Yes", the process proceeds to the sub-routine S33, and, like the first loop, comparison in the second loop is performed in accordance with the flowchart illustrated in FIG. 20.

In comparison in the second loop of the table illustrated in FIG. 19B, the stitch of the counter value "2" is sequentially compared with subsequent stitches of the sub-counter values "3" to "9" whose item "valid/invalid" is "valid", the stitches of the sub-counter values "3" and "6" not satisfying the condition (b) are rewritten from "valid" to "invalid", and these stitches are removed from the candidates.

Thereafter, when the comparison in the second loop of the table ends, the process proceeds to step S34 in the flowchart illustrated in FIG. 17, and it is determined in step S34 whether the counter is at the end of the table. Since the counter value is "2", it is determined "No", the process proceeds to step S35, "2" held in the counter is incremented by one to be "3" in step S35, and the process returns to step S32.

Next in step S32, it is determined whether "a stitch of the counter value is valid". In this case, since the stitch of the counter value "3" is "invalid" as illustrated in FIG. 19C, it is determined "No", and the process proceeds to step S34. Since the counter value is "3", it is determined "No" in step S34, the process proceeds to step S35, "3" held in the counter is incremented by one to be "4" in step S35, and the process returns to step S32.

Again in step S32, it is determined whether "a stitch of the counter value is valid". This time, since the stitch of the counter value "4" is "valid", it is determined "Yes", and, like the second loop, comparison in the third loop is performed in accordance with the flowchart illustrated in FIG. 20.

In comparison in the third loop of the table illustrated in FIG. 19C, like the second loop, the stitch of the counter value "4" is sequentially compared with subsequent stitches of the sub-counter values "5" and "7" to "9" whose item "valid/invalid" is "valid", the stitches of the sub-counter values "5" and "7" to "9" not satisfying the condition (b) are rewritten from "valid" to "invalid", and these stitches are removed from the candidates.

Thereafter, when the comparison in the third loop of the table ends, the process proceeds to step S34 in the flowchart illustrated in FIG. 17, and it is determined in step S34 whether the counter is at the end of the table. Since the counter value is "4", it is determined "No", the process proceeds to step S35, "4" held in the counter is incremented by one to be "5" in step S35, and the process returns to step S32.

As illustrated in FIG. 19C, since the item "valid/invalid" in the table of the stitches from the counter value "5" onward is "invalid", it is determined "No" in step S32, and the process proceeds to step S34.

Thereafter, since it is determined "No" in step S34 until the counter reaches the end of the table, the process going through S35 and S32 and returning to step S34 is repeated.

When the counter finally reaches the end of the table, it is determined "Yes" in step S34, and the process of listing needle position candidates ends.

As has been described above, in this specific example, as illustrated in FIG. 16B, when the user touches the dot D1, among the needle positions A to J at the dot D1 and the dots D2 within one dot from the dot D1, only the needle positions B (18-th stitch), E (203-rd stitch), and I (240-th stitch) serve as candidates, as illustrated in FIG. 19C.

In the displayed list, illustrated by way of example in FIG. 15, the items "layer number", "thread color", "needle position", and "number of stitches to be set" are set as items of the candidate list. However, the items may be decreased as necessary, or may be increased to include items such as "remaining stitching time" and "enlarged display".

The candidate list is not limited to a tabular form like that illustrated in FIG. 15, and may be a selection button where a needle position image is displayed.

Furthermore, although the order of candidates displayed in the candidate list is the ascending order of the "number of stitches to be set" in the embodiment, the candidates may alternatively be displayed in the descending order of possibility of being selected by the user. For example, the candidates may be displayed in the following order:

Immediately after a thread breaking error, stitching is resumed from the thread break position. Thus, candidates prior to the current stitch ordinal number position in the layer where stitching is interrupted are preferentially displayed.

When stitching is interrupted, thread on the thread spool or bobbin may have run out. Thus, candidates prior to the current stitch ordinal number position in the layer where stitching is interrupted are preferentially displayed.

When the user touches a position near the beginning of a layer before stitching starts, the user may want to start stitching from the beginning of the specified layer. Thus, the beginning of the layer is preferentially displayed.

Candidates nearer to the current stitch ordinal number position are displayed first.

When the candidate list is displayed as illustrated in FIG. 15, from the candidate list, the user touches the candidate L2 near a needle position that the user targets with the stylus 30.

Figure 21:
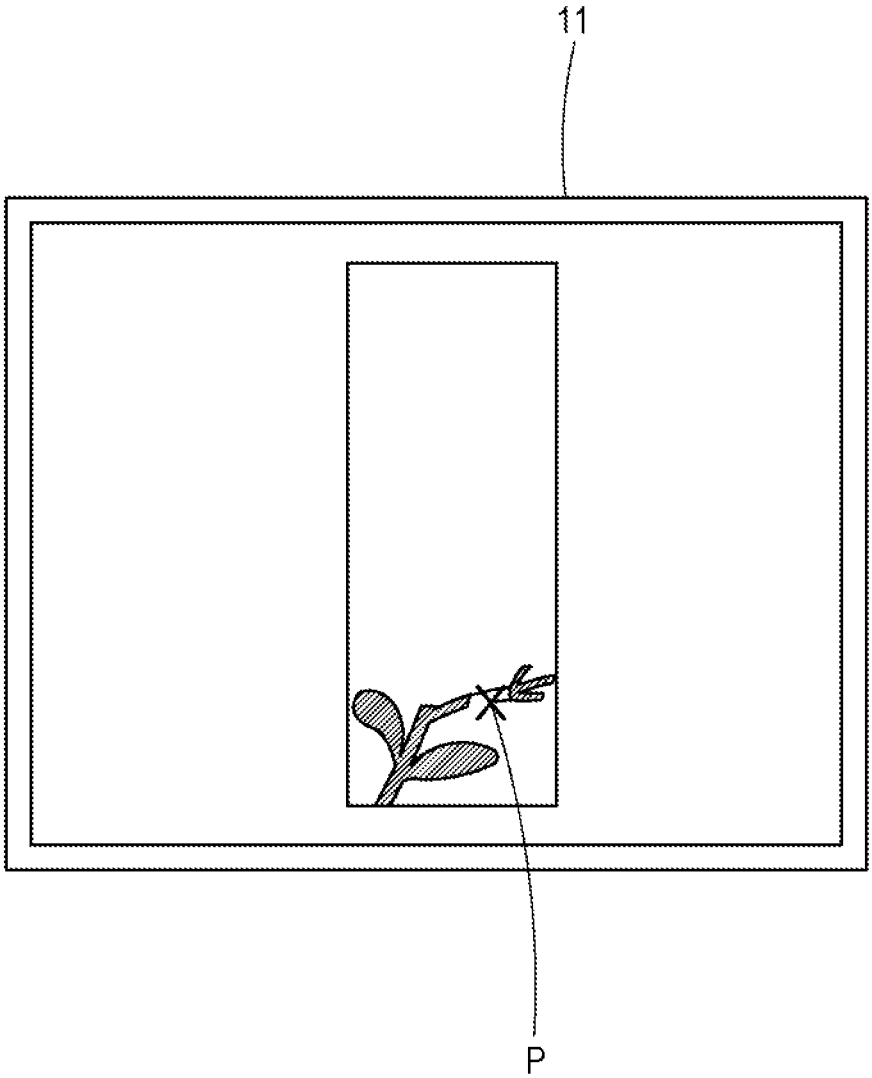
FIG. 21 is a display example of the display device which switches its display before and after the needle position at the start of stitching.

In response, as illustrated in FIG. 21, the specified needle position becomes the stitching start position, and the pattern display in the pattern display window 11 changes before and after the stitching start needle position marked with "x".

As has been described above, when stitches are concentrated, for the procedure of selecting a needle position from a displayed candidate list, a mode of moving the embroidery frame 6 and resuming embroidery stitching from a desired stitching start needle position by touching the embroidery pattern displayed in the pattern display window 11 with the stylus 30 will be described using the flowchart illustrated in FIG. 22.

Figure 22:
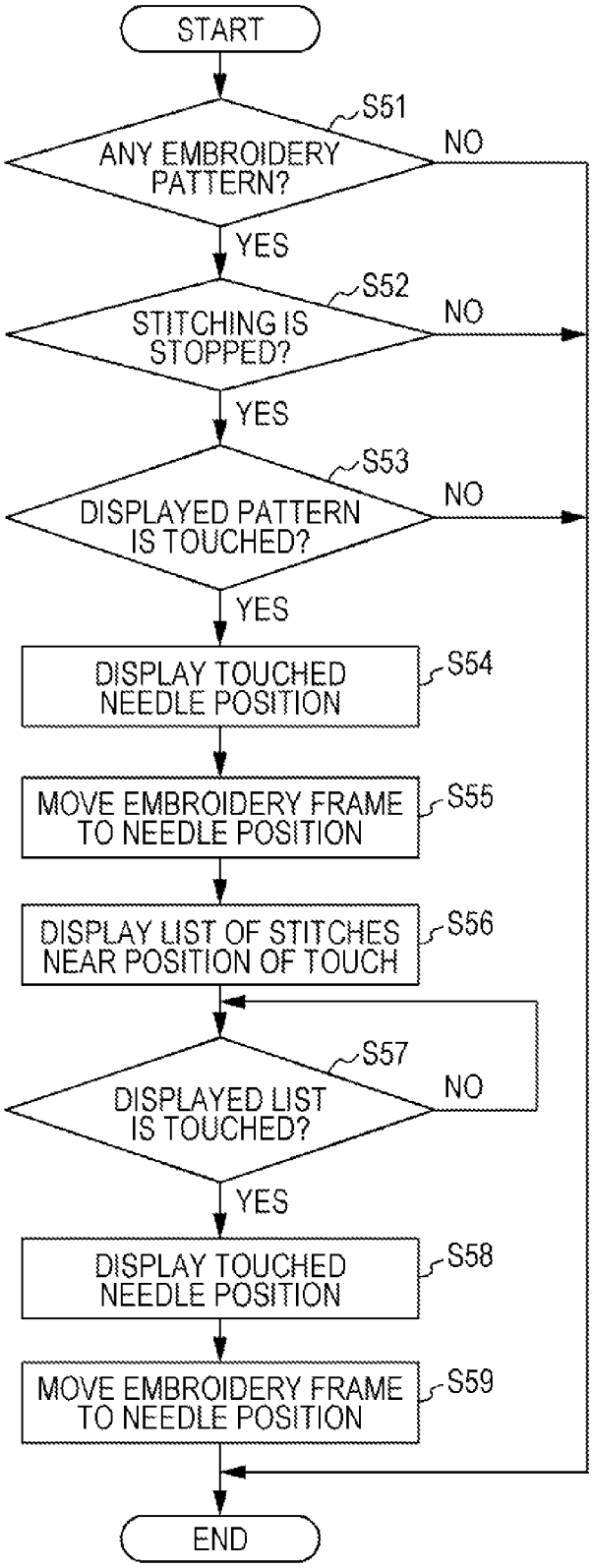
FIG. 22 is a flowchart illustrating a mode of moving the embroidery frame to a desired needle position based on a displayed candidate list and resuming embroidery stitching when stitches are concentrated at the position of touch.
Figure 23A:
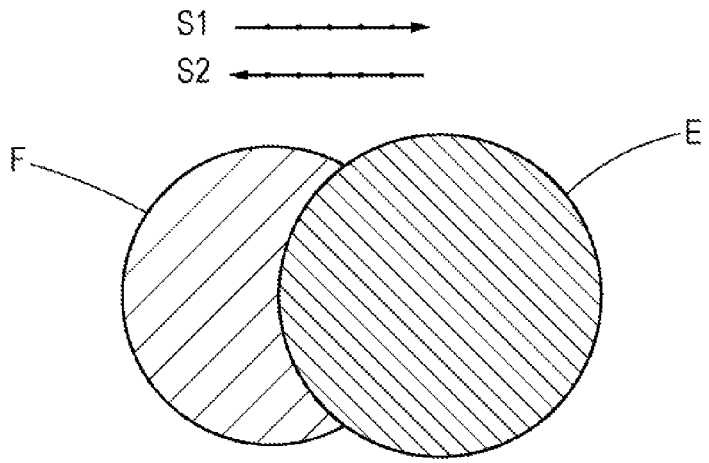
FIGS. 23A to 23C are schematic diagrams illustrating a state where adjacent portions of an embroidery pattern that are mat-stitched pucker, namely.
Figure 23B:
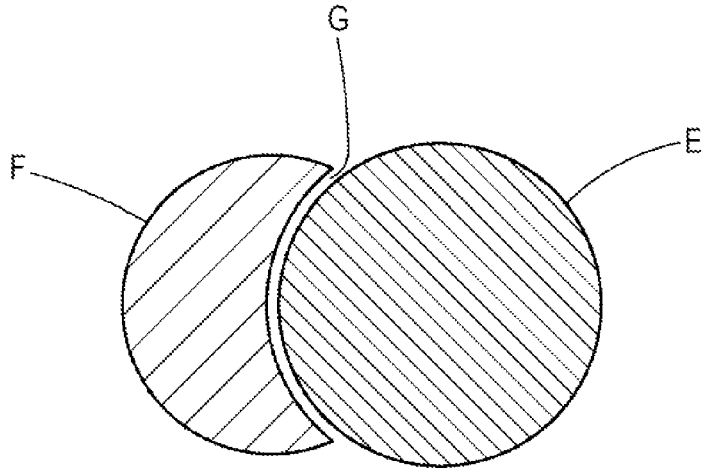
Figure 23C:
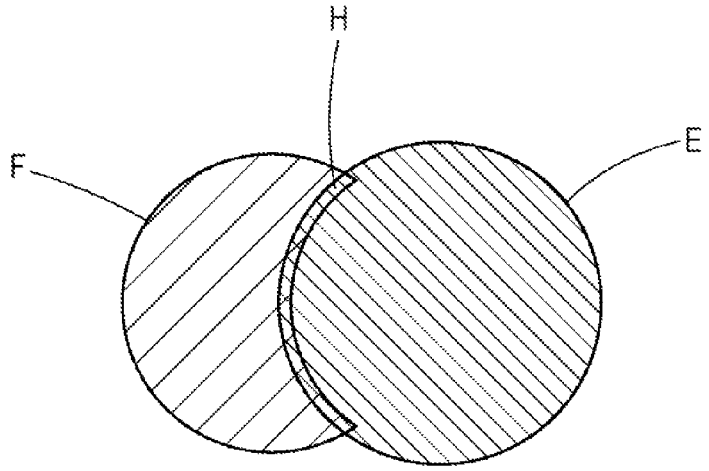

Referring to FIG. 22, since steps S51 to S55 are the same as steps S1 to S5 illustrated in FIG. 7 in the above-described case where there is one touch candidate, descriptions thereof are omitted.

In step S56, since the position of touch on the embroidery pattern is a portion where stitches are concentrated, as illustrated in FIG. 15, a list of candidates for the stitching start needle position is displayed in the pattern display window 11, and the process proceeds to step S57.

Next in step S57, to wait for the user to touch any of the candidates in the candidate list displayed in the pattern display window 11, it is determined whether "the displayed list is touched". When nowhere in the displayed list in the pattern display window 11 is touched, it is determined "No", and the process returns to step S57.

Again in step S57, as illustrated in FIG. 15, when the user touches any of the candidates in the displayed list with the stylus 30, it is determined "Yes", and the process proceeds to step S58.

Next in step S58, to display the touched needle position, as illustrated in FIG. 21, the color of the displayed pattern is changed before and after the needle position (point P) specified by the user, and the process proceeds to step S59.

Next in step S59, the sewing machine remains inactive, and only the embroidery frame 6 is moved from the current position (end position) to the user-specified needle position.

In the embodiment, to specify a stitching start needle position by touching an embroidery pattern displayed in the pattern display window 11, even when stitches are concentrated at a portion touched by the user, needle positions serving as candidates are listed on the basis of predetermined conditions and are displayed in the descending order of possibility of being selected. Thus, the user can move the embroidery frame 6 to a desired needle position simply by selecting an appropriate candidate from the candidate list.

An embroidery sewing machine according to the present invention graphically displays an embroidery pattern on a display device, and displays a list of needle positions serving as candidates simply by directly touching, by the user, a place on the displayed pattern that the user wants to start stitching. The embroidery frame can be moved to a desired needle position simply by selecting an appropriate candidate from the displayed candidate list. The sewing machine is widely applicable to and advantageous in various sewing machines.

What is claimed is:

1. An embroidery sewing machine that moves an embroidery frame, to which fabric is attached, in X- and Y-directions with respect to a needle reciprocating vertically at a fixed position, and that stitches an embroidery pattern, the embroidery sewing machine comprising:

a storage device that stores, for each stitch ordinal number, coordinate data of the embroidery pattern including a plurality of layers;

an X-Y moving mechanism that moves the embroidery frame in the X- and Y-directions on the basis of the coordinate data stored in the storage device;

a display device that displays the embroidery pattern on the basis of the coordinate data stored in the storage device;

a transparent touchscreen stacked on a front face of the display device;

a touch point detector that detects a position of touch on the touchscreen, the position being on the embroidery pattern displayed on the display device;

a coordinate data extracting unit that extracts coordinate data for each stitch ordinal number, the coordinate data being within a certain distance from the position of touch detected by the touch point detector;

a coordinate data selecting unit that selects a coordinate data candidate from the coordinate data extracted by the coordinate data extracting unit;

a candidate list display unit that lists a needle position candidate based on the coordinate data selected by the coordinate data selecting unit and displays the list on the display device; and a coordinate data supplying unit that supplies, when any needle position is specified from the needle position candidate displayed on the display device by the candidate list display unit, the X-Y moving mechanism with coordinate data of the specified needle position, and moves the embroidery frame to the needle position.

2. The embroidery sewing machine according to claim 1, wherein the coordinate data selecting unit includes a comparator that compares items of coordinate data extracted by the coordinate data extracting unit to determine whether coordinate data serving as a candidate and to-be-compared coordinate data are in different layers or, even when the items of coordinate data are in an identical layer, whether the items of coordinate data are distant from each other by a certain number of stitches or more.

3. The embroidery sewing machine according to claim 2, further comprising:

a touch point display unit that displays, on the embroidery pattern displayed on the display device, the position of touch detected by the touch point detector.

4. The embroidery sewing machine according to claim 1, wherein the candidate list display unit includes a tabular form display unit that displays the needle position candidate in a tabular form classified by item.

5. The embroidery sewing machine according to claim 4, wherein the coordinate data selecting unit includes a comparator that compares items of coordinate data extracted by the coordinate data extracting unit to determine whether coordinate data serving as a candidate and to-be-compared coordinate data are in different layers or, even when the items of coordinate data are in an identical layer, whether the items of coordinate data are distant from each other by a certain number of stitches or more.

6. The embroidery sewing machine according to claim 5, further comprising:

a touch point display unit that displays, on the embroidery pattern displayed on the display device, the position of touch detected by the touch point detector.

7. The embroidery sewing machine according to claim 4, further comprising:

a touch point display unit that displays, on the embroidery pattern displayed on the display device, the position of touch detected by the touch point detector.

8. The embroidery sewing machine according to claim 1, wherein the coordinate data supplying unit includes:

a needle position specifying unit that specifies any needle position from the needle position candidate displayed on the display device by the candidate list display unit; and a needle position display unit that displays the needle position specified by the needle position specifying unit on the display device.

9. The embroidery sewing machine according to claim 8, wherein the candidate list display unit includes a tabular form display unit that displays the needle position candidate in a tabular form classified by item.

10. The embroidery sewing machine according to claim 9, wherein the needle position display unit includes a representation changing unit that changes a representation displayed on the display device before and after the needle position specified by the needle position specifying unit.

11. The embroidery sewing machine according to claim 10, further comprising:

a touch point display unit that displays, on the embroidery pattern displayed on the display device, the position of touch detected by the touch point detector.

12. The embroidery sewing machine according to claim 9, further comprising:

a touch point display unit that displays, on the embroidery pattern displayed on the display device, the position of touch detected by the touch point detector.

13. The embroidery sewing machine according to claim 8, wherein the coordinate data selecting unit includes a comparator that compares items of coordinate data extracted by the coordinate data extracting unit to determine whether coordinate data serving as a candidate and to-be-compared coordinate data are in different layers or, even when the items of coordinate data are in an identical layer, whether the items of coordinate data are distant from each other by a certain number of stitches or more.

14. The embroidery sewing machine according to claim 13, wherein the needle position display unit includes a representation changing unit that changes a representation displayed on the display device before and after the needle position specified by the needle position specifying unit.

15. The embroidery sewing machine according to claim 14, further comprising:

a touch point display unit that displays, on the embroidery pattern displayed on the display device, the position of touch detected by the touch point detector.

16. The embroidery sewing machine according to claim 13, further comprising:

a touch point display unit that displays, on the embroidery pattern displayed on the display device, the position of touch detected by the touch point detector.

17. The embroidery sewing machine according to claim 13, wherein the candidate list display unit includes a tabular form display unit that displays the needle position candidate in a tabular form classified by item.

18. The embroidery sewing machine according to claim 17, wherein the needle position display unit includes a representation changing unit that changes a representation displayed on the display device before and after the needle position specified by the needle position specifying unit.

19. The embroidery sewing machine according to claim 18, further comprising:

a touch point display unit that displays, on the embroidery pattern displayed on the display device, the position of touch detected by the touch point detector.

20. The embroidery sewing machine according to claim 17, further comprising:

a touch point display unit that displays, on the embroidery pattern displayed on the display device, the position of touch detected by the touch point detector.

21. The embroidery sewing machine according to claim 8, further comprising:

a touch point display unit that displays, on the embroidery pattern displayed on the display device, the position of touch detected by the touch point detector.

22. The embroidery sewing machine according to claim 8, wherein the needle position display unit includes a representation changing unit that changes a representation displayed on the display device before and after the needle position specified by the needle position specifying unit.

23. The embroidery sewing machine according to claim 22, further comprising:

a touch point display unit that displays, on the embroidery pattern displayed on the display device, the position of touch detected by the touch point detector.

24. The embroidery sewing machine according to claim 1, further comprising:

a touch point display unit that displays, on the embroidery pattern displayed on the display device, the position of touch detected by the touch point detector.

* * * * *